US006459861B1

(12) United States Patent
Sakurai et al.

(10) Patent No.: US 6,459,861 B1
(45) **Date of Patent: *Oct. 1, 2002**

(54) IMAGE FORMING APPARATUS, AND A CARTRIDGE HAVING A DEVELOPER CONTAINER DETACHABLY MOUNTABLE ON SUCH APPARATUS

(75) Inventors: Kazushige Sakurai, Gotenba (JP); Hiroshi Sato, Shizuoka-ken (JP); Kazumi Yamauchi, Numazu (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/352,202

(22) Filed: Jul. 13, 1999

Related U.S. Application Data

(63) Continuation of application No. 08/736,128, filed on Oct. 24, 1996, now Pat. No. 5,923,917.

(30) Foreign Application Priority Data

Oct. 25, 1995 (JP) ..... 7-299342
Oct. 25, 1995 (JP) ..... 7-299343

(51) Int. Cl.[7] ..... G03G 15/00; G03G 15/08
(52) U.S. Cl. ..... 399/27; 399/43; 399/45; 399/111
(58) Field of Search ..... 399/24, 25, 27, 399/29, 30, 58, 59, 61, 62, 111, 43, 45

(56) References Cited

U.S. PATENT DOCUMENTS

| | | | | |
|---|---|---|---|---|
| 4,626,096 A | | 12/1986 | Ohtsuka et al. | 399/27 |
| 5,095,331 A | | 3/1992 | Takano | 399/27 X |
| 5,105,219 A | | 4/1992 | Yoshikado | 399/27 |
| 5,160,966 A | | 11/1992 | Shiina et al. | 399/27 |
| 5,162,848 A | | 11/1992 | Saitoh et al. | 399/27 |
| 5,235,384 A | | 8/1993 | Oka et al. | 399/27 |
| 5,572,292 A | | 11/1996 | Chatani et al. | 399/25 |
| 5,635,972 A | | 6/1997 | Maruyama et al. | 399/30 X |
| 5,699,091 A | | 12/1997 | Bullock et al. | 399/24 X |
| 5,708,912 A | * | 1/1998 | Lee | 399/24 |
| 5,802,419 A | | 9/1998 | Sakurai et al. | 399/26 |
| 5,802,420 A | * | 9/1998 | Garr et al. | 399/27 |
| 6,035,150 A | * | 3/2000 | Domon et al. | 399/27 |
| 6,223,131 B1 | * | 4/2001 | Kanaya et al. | 399/24 X |
| 6,343,193 B1 | * | 1/2002 | Matsumoto et al. | 399/27 |

FOREIGN PATENT DOCUMENTS

| | | |
|---|---|---|
| JP | 61-185761 | 8/1986 |
| JP | 62-062352 | 3/1987 |
| JP | 63-212956 | 9/1988 |

* cited by examiner

*Primary Examiner*—Sophia S. Chen
(74) *Attorney, Agent, or Firm*—Fitzpatrick, Cella, Harper & Scinto

(57) ABSTRACT

An image forming apparatus for forming images on a recording material includes an electrophotosensitive member. A developing devices develops a latent image formed on the electrophotosensitive member by using a developing agent contained in a container. A memory stores information with respect to an amount of consumption of the developing agent. A computing device computes a number of printable recording materials in accordance with the information, with respect to the amount of consumption of the developing agent, stored in the memory and a consumption rate information of the developing agent. An information output device outputs information of the number of printable recording material computed by the computing device.

39 Claims, 15 Drawing Sheets

IMAGE FORMING APPARATUS, AND A CARTRIDGE HAVING A DEVELOPER CONTAINER DETACHABLY MOUNTABLE ON SUCH APPARATUS

This is a continuation of allowed U.S. patent application Ser. No. 08/736,128, filed Oct. 24, 1996, now U.S. Pat. No. 5,923,917.

BACKGROUND OF THE INVENTION

1. Field of the Invention

The present invention relates to an image forming apparatus using electrophotographic technologies, such as a copying machine and a printer. More particularly, the invention relates to an image forming apparatus provided with a cartridge having a developer container in it, which is detachably mountable on such apparatus.

2. Related Background Art

Conventionally, for a cartridge type electrophotographic image forming apparatus, there has been adopted a process cartridge method or the like, which makes it possible to detachably mount a cartridge on the main body of an electrophotographic image forming apparatus by arranging the cartridge to be formed integrally with an electrophotographic photosensitive element and processing means. In accordance with a process cartridge method of this kind, it is possible for the user to maintain the apparatus by himself without any help from a serviceman. Therefore, its operativity has been enhanced significantly. The process cartridge method is now widely adopted for electrophotographic image forming apparatuses. Also, in consideration of the cartridge replacement to be made by the user himself for the maintenance of the apparatus as described above, warning means is provided to indicate on a display an amount of toner that has become small by detecting the residual toner amount in the development device, thus prompting the user to replace cartridges before the image density is lowered or some other defects may take place.

Also, there has been proposed a method whereby to count and store the frequency of use of a cartridge by the utilization of an EEPROM or other non-volatile memory means. For example, in accordance with Japanese Patent Laid-Open Application No. 61-185761, a description has been made of an electrophotographic image forming apparatus, which is provided with means for counting and storing information regarding toner reminders on the basis of information on the period of exposure each time images are recorded by means of laser beam, light emitting diode, or the like, on the photosensitive drum in a process cartridge.

Also, a cartridge of this kind is often mounted on or demounted from the main body of an apparatus. With this in view, a proposal has been made to enhance the accuracy of detection by providing memory means in the cartridge itself when a plurality of cartridges are used for one main body of the apparatus. For example, in accordance with Japanese Patent Laid-Open Application No. 63-212956, an electrophotographic image forming apparatus is proposed, wherein memory means is arranged in a cartridge, while it is arranged to provide the main body of the apparatus with means for reading from the memory and writing to it, and means for computing information related to the life of the cartridge on the basis of the contents read out from such memory means and the electrophotographic operations that have been carried out, and then, writing such information to the memory.

Also, as another method for detecting the consumption of toner, there has been proposed a method whereby to directly detect residual toner amount in a cartridge. For example, in accordance with Japanese Patent Laid-Open Application No. 62-62352, description is made of a method whereby to arrange a detection antenna in the vicinity of a development sleeve, which serves as a developer carrier, and measure each current induced to the antenna when an AC voltage is applied to the development sleeve, and then, to execute the toner detection by the utilization of the status changes of such current that may take place between the sleeve and the antenna depending on the residual toner amounts.

SUMMARY OF THE INVENTION

It is an object of the present invention to provide an image forming apparatus and a cartridge, which are capable of obtaining the residual amount of developer more accurately than the apparatuses that have been proposed conventionally.

It is another object of the invention to provide an image forming apparatus and a cartridge, which are capable of making the residual developer amount smaller.

It is still another object of the invention to provide an image forming apparatus and a cartridge, which are capable of informing the user of the life of the cartridge accurately.

It is a further object of the invention to provide an image forming apparatus and a cartridge, which are capable of informing the user of the life of the cartridge and the amount of residual developer in it accurately even if a used cartridge is mounted on the apparatus.

It is still a further object of the invention to provide an image forming apparatus comprising:

a cartridge, which is provided with a developer container, means for detecting its residual amount to detect the developer still remaining in the container, and memory means to store rewritable data on it;

access means to access data on the memory means, which writes on the memory the data on the number of printing sheets after the detected amount of the residual amount detection means arrives at a predetermined value; and indication means to indicate the absence of developer when the data on the number of printing sheets on the memory arrives at the predetermined value.

Other objectives, features, and advantages of the invention will be apparent to those skilled in the art from the description of a preferred embodiment of the invention which follows. In the description, reference is made to accompanying drawings, which form a part thereof, and which illustrate an example of the invention. Such example, however, is not exhaustive of the various embodiments of the invention, and therefore reference is made to the claims which follow the description for determining the scope of the invention.

DETAILED DESCRIPTION OF THE PREFERRED EMBODIMENTS

Hereinafter, with reference to the accompanying drawings, a description will be made of an electrophotographic image forming apparatus, a process cartridge, and a development device further in detail in accordance with the present invention.

First Embodiment

At first, referring to FIG. 1, a description will be made of an electrophotographic image forming apparatus capable of detachably mounting a process cartridge on it in accordance with a first embodiment of the present invention.

Figure 1:
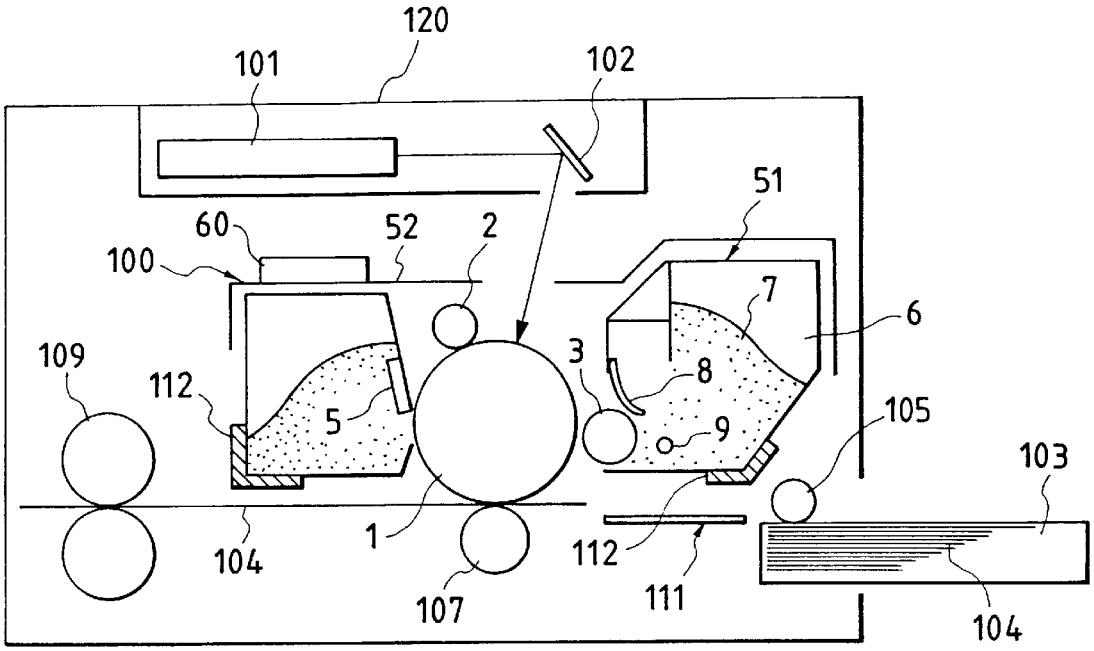
FIG. 1 is a side sectional view showing an electrophotographic image forming apparatus in accordance with one embodiment of the present invention.

As shown in FIG. 1, the electrophotographic image forming apparatus is arranged to output the laser beam, which is modulated according to image signals, from a scanner unit 101 including laser, and lenses of polygonal mirror correction system. Then, the laser beam is reflected by a reflection mirror 102 to be irradiated upon a photosensitive drum (electrophotographic photosensitive element) 1. The photosensitive drum 1 is uniformly charged in advance by means of a charging roller (charging means) 2. With the irradiation of laser beam, an electrostatic latent image is formed on the surface thereof. Developer (toner) 7 retained in a developer container 6 of a development unit 51 is carried on the circumferential surface of a development roller (developing means) 3, while being charged, thus forming on the development roller 3 a toner layer that can be developed. The electrostatic latent image described above is developed by means of the toner layer, and made visible as a toner.

Figure 2:
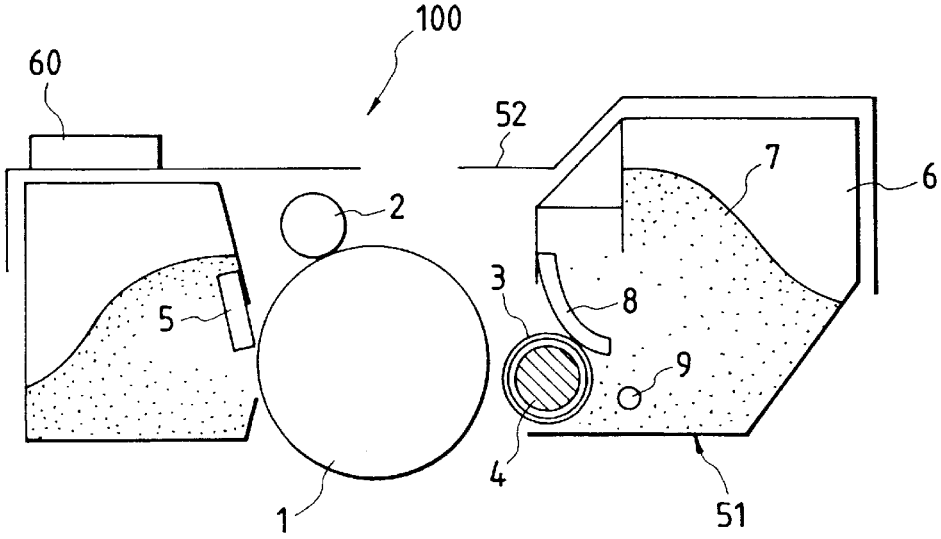
FIG. 2 is a side sectional view showing a process cartridge in accordance with a first embodiment.

A transfer material (recording medium) 104 housed in a cassette 103 is supplied by means of a feed roller 105 in synchronism with the formation of the latent image on the photosensitive drum 1. The transfer material 104 is carried to a roller type transfer means 107 through guide means 111 in synchronism with the movement of the leading end of the toner image on the photosensitive drum 1. Then, the toner image is transferred onto the transfer material 104 by transfer means 107. The transfer material 104 having the toner image thus transferred is carried to a fixing device 109 through an appropriate carrier means (not shown), thus fixing the toner image as a permanent image. A process cartridge 100 shown in FIG. 2 is arranged as a unit by integrally forming a photosensitive drum 1, a charging roller 2, a development unit 51, cleaning means 5 having an elastic cleaning blade, and a cover 52 serving as a frame to enclose these members. The photosensitive drum 1 and other members are assembled in the interior of the process cartridge 100 with given interrelated positional relationship. It is also made possible to insert the process cartridge 100 into a given location (mounting means 112) of the main body of an electrophotographic image forming apparatus through specific procedures, and also, to remove it from the main body of the apparatus inversely.

In this respect, the development unit 51 is provided with a development blade 8 to regulate the thickness of the toner layer on the development sleeve 3, and means 9 for detecting the residual amount of developer (toner) to detect the residual amount of toner 7 in the developer container 6. In the interior of the development sleeve 3, a magnet 4 is fixed. Also, the process cartridge 100 (hereinafter, simply referred to as a cartridge) described earlier is replaced by the user himself when toner 7 retained in the developer container 6 is consumed or the life of the photosensitive drum 1 terminates.

The features of the present invention are means 9 for detecting residual toner amount and memory means 60 are provided for the cartridge 100, and the amount of toner that has been consumed is worked out in accordance with the information on the frequency of use of the cartridge, which is stored on the memory means 60, thus detecting the residual toner amount in the cartridge only with small errors, and informing the user accordingly in succession. As memory means 60, although there is no particular preference as far as such means can store and hold signal information rewritably, a RAM, a rewritable ROM, or any other electrical storage means, or a magnetic storage medium, a magnetic bubble memory, an optomagnetic memory, or other magnetic storage means can be used. For the present embodiment, a NV (Non Volatile) RAM, which serves as a nonvolatile memory means, is used from the viewpoint of an easier handling and lower costs.

As a mechanism to detect residual toner amounts, which is adoptable for the present invention, any one of known structures is usable without any particular limit to it if only such structure is fundamentally adoptable for detecting the residual toner amount when it becomes less than a given value. More specifically, it is possible to use a structure of such a type that carries out a voluminal detection, a type that uses a magnetic sensor, a type that detects the weight of toner, a type that utilizes transmission of light, or the like.

Figure 3:
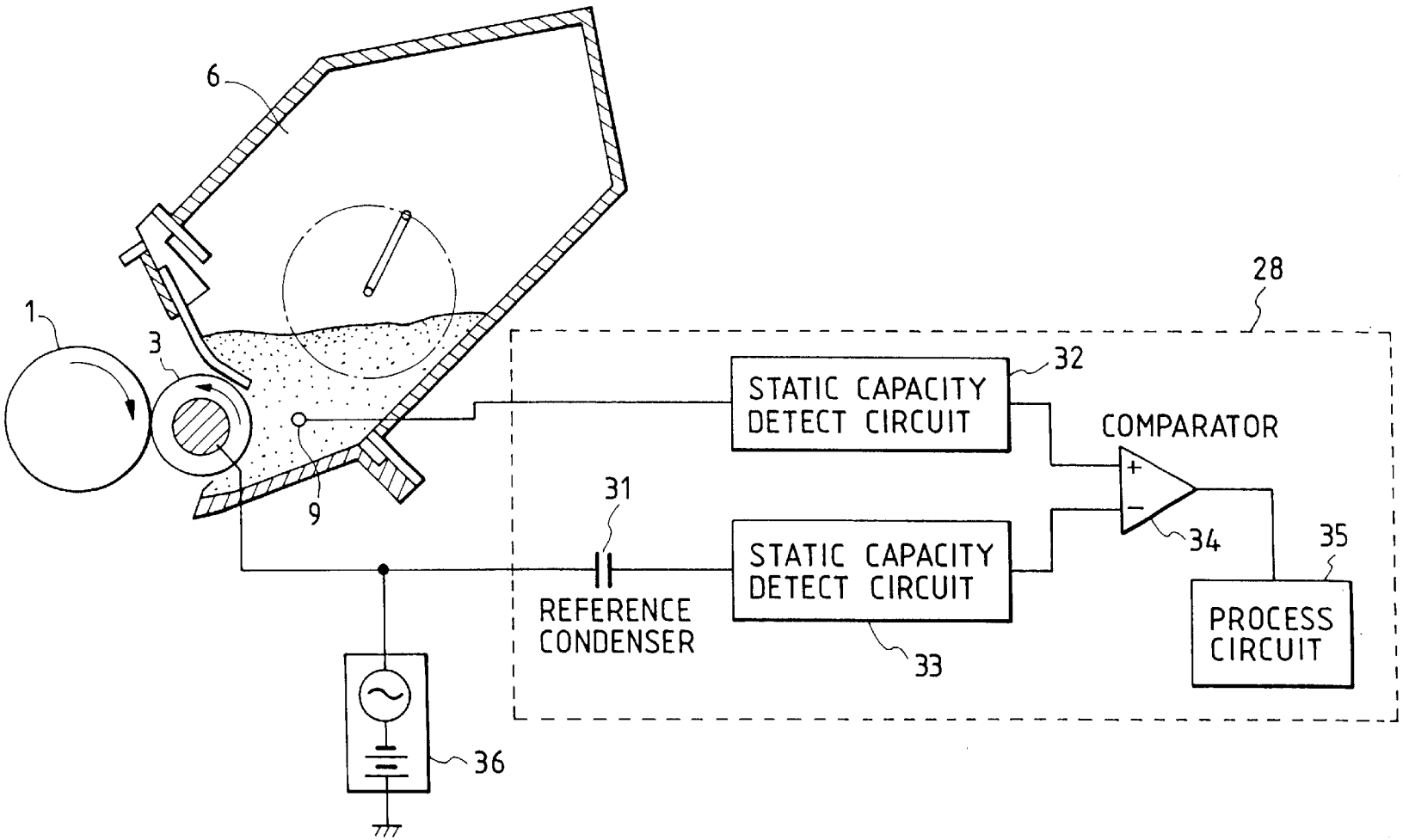
FIG. 3 is a view illustrating a mechanism to detect residual developer amounts, which is usable for the present invention.

FIG. 3 shows one example of a mechanism to detect residual toner amounts, which is usable for the first embodiment. For the first embodiment, means for detecting residual toner amounts is an antenna type electrode 9 installed in the interior of the development device 6, and an AC voltage is applied from a power-supply 36 across the electrode and a development sleeve 3, which serves as a carrier of developer. A residual toner amount detection circuit (means for detecting residual toner amounts) 28 is arranged in the main body of the apparatus. The static capacitance detection circuit 32 of this detection circuit 28 obtains the static capacitance across the electrode 9 and the development sleeve 3, while the static capacitance circuit 33 obtains the static capacitance of a reference capacitor 31. The capacitances thus obtained are compared by means of a comparator 34. If the difference between the capacitances detected by the comparator 34 is negative, it is interpreted that the residual toner amount is less than a given value, thus executing a given process by means of a processing circuit 35. In this way, therefore, it is possible to set arbitrarily a residual toner amount to be detected by adjusting the capacitance of the reference capacitor.

Now, with reference to FIG. 4 and FIG. 5, a description will be made of the operation of residual toner amount detection in accordance with the first embodiment.

Figure 4:
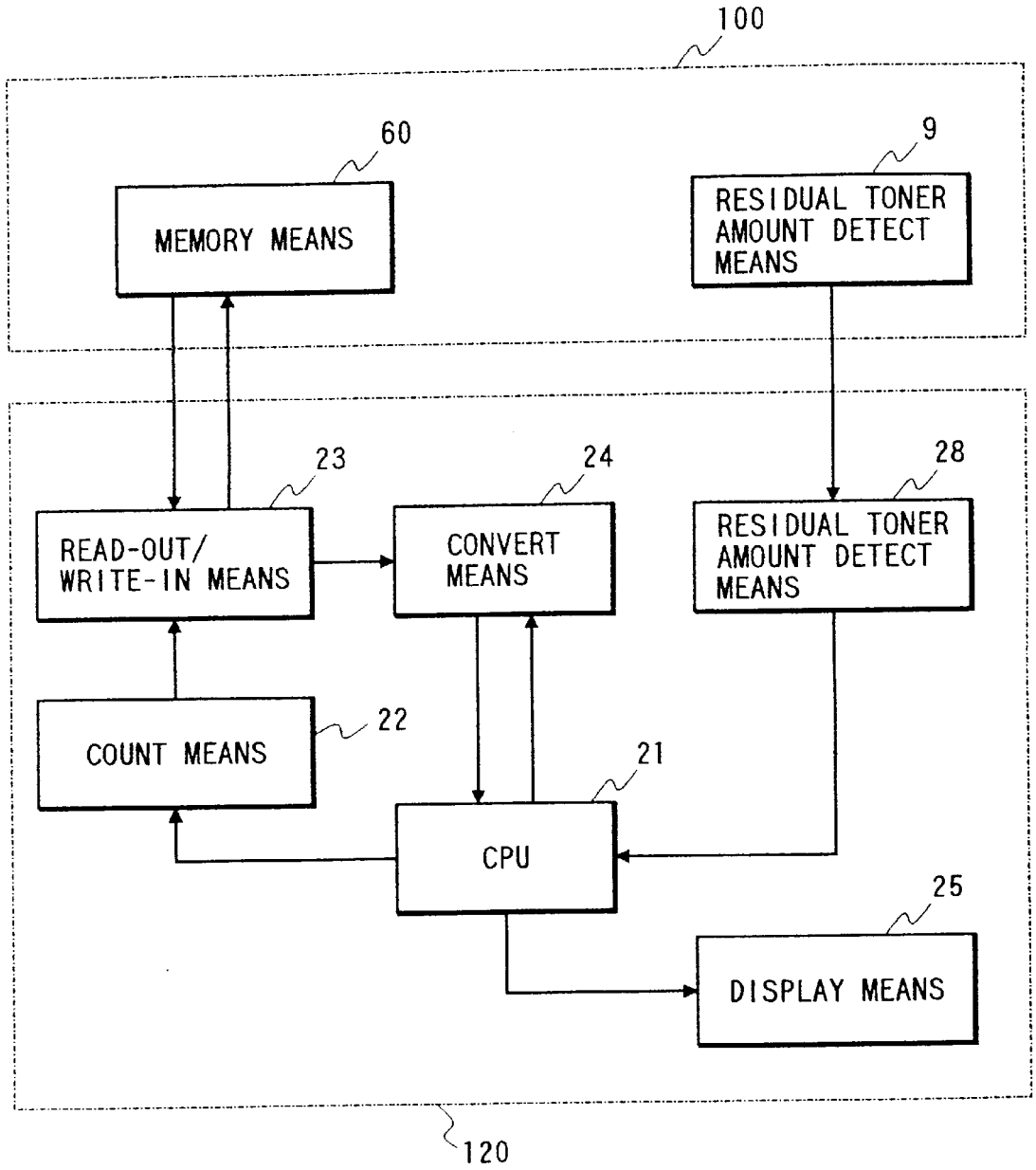
FIG. 4 is a block diagram illustrating the operation of an apparatus in accordance with the first embodiment.
Figure 5:
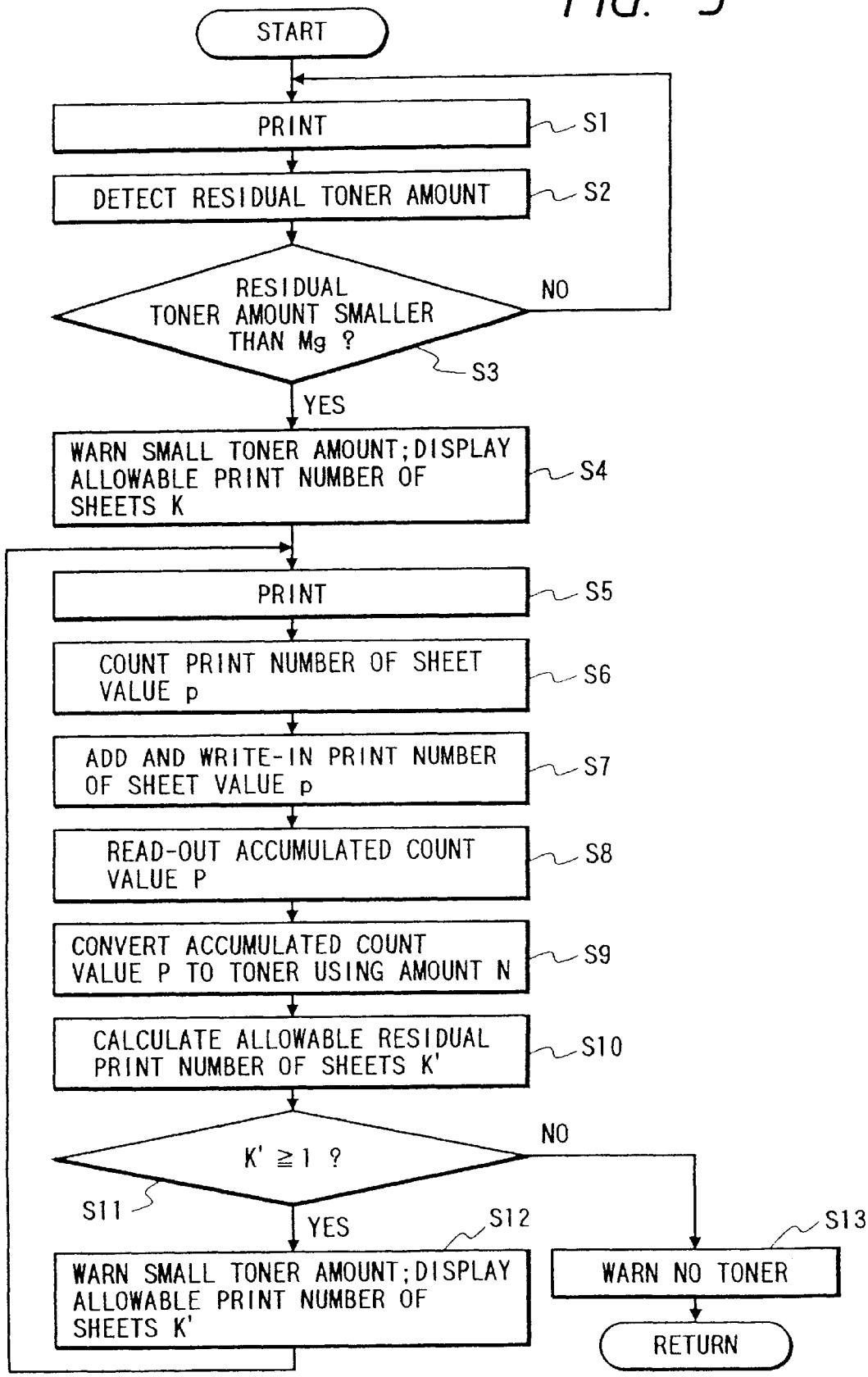
FIG. 5 is a flowchart illustrating the operation of the apparatus in accordance with the first embodiment.

FIG. 4 is a block diagram illustrating the residual toner amount detection mechanism of an electrophotographic image forming apparatus in accordance with the first embodiment. In FIG. 4, a cartridge 100 is provided with means 9 for detecting residual toner amounts, and memory means 60 for storing information on the frequency of use of the cartridge. The main body 120 of the electrophotographic image forming apparatus is provided with means for detecting residual toner amounts, that is, the residual toner amount detection circuit 28. For the first embodiment, the information on the frequency of use of the cartridge begins to be stored in the memory means 60 in the cartridge when the residual toner amount detection circuit 28 determines that toner becomes less than a given amount in accordance with signals from the means 9 for detecting residual toner amounts.

Information on the frequency of use of a cartridge of the present invention is fundamentally any amount that may correspond to the one for which the cartridge has been used for the formation of images. More specifically, the number of printed sheets, the period during which the photosensitive element has been driven, the period during which bias has been given to development, or the like, may be usable for the provision of such information. Information on the frequency of use is converted into a counted value by counting means 22 on the basis of the driving signals transmitted from the CPU 21 in the main body 120 of the apparatus, and written additionally on the memory means 60 by use of read/write means 23.

Information on the frequency of use thus written to the memory means 60 is read out again to the electrophotographic image forming apparatus by use of read/write means 23, and transferred to conversion means 24. The conversion means 24 is connected with the CPU 21, and calculates the consumed toner amount in accordance with data on toner consumption corresponding to unit amount of use defined in advance on the CPU 21. The calculated toner consumption is transferred to the CPU 21, and then, the residual toner amount or the remaining printable sheets are worked out in the CPU 21, the result of which is informed to the user by use of display means 25.

Now, with reference to a flowchart shown in FIG. 5, a description will be made of the actual operation of an apparatus in accordance with the present embodiment. In this respect, a counted value of printing sheets is used as information on the frequency of use in the description given below.

At first, when printing is executed (step S1), the residual toner amount is detected by means for detecting residual toner amounts, that is, by use of the residual toner amount detection circuit 28 (step S2), thus determining whether or not toner becomes less than a given value of M gram (step S3). The toner amount determined by the residual toner amount detection circuit 28 can be set arbitrarily by arranging the decision level of the residual toner amount detection circuit 28 as described earlier.

Here, if it is determined that toner still remains in an amount of more than M gram, the steps S1 to S3 are repeated. If it is determined that the residual toner amount becomes less than M gram, the user is warned to the effect that the residual toner amount is now small. Then, in accordance with the following formula (1), the remaining printable sheets K are calculated:

$$K(\text{sheets})=(M(g)-R(g))/S(g/\text{sheets}) \quad (1)$$

where S: An amount of toner consumption per sheet at a standard printing rate for A4-sized sheets;

R: An amount of toner on a limit where white void images appear due to the insufficient amount of toner.

When printing is further executed after the residual toner amount has become less than M gram (step S5), the value p of printing sheets is counted by the counting means 22 (step S6), and additionally written to the memory means by the read/write means 23 (step S7). The counted value P of the printed sheet numbers written to the memory means 60 are read out again to the main body (step S8), which is converted into a consumed toner amount N by the conversion means 24 in accordance with the following formula (2) (step S9):

$$N(g)=P(\text{sheets})\times L(g) \quad (2)$$

where L: A standard amount of toner to be consumed per unit amount of use.

Then, remaining printable sheets K' is worked out in accordance with the following formula (3) using the consumed toner amount N converted from the counted value and the residual toner amount M set by the residual toner amount detection circuit 28 (step S10):

$$K'(\text{sheets})=(M(g)-N(g)-R(g))/S(g/\text{sheets}) \quad (3)$$

Here, the value K' is examined (step S11), and then, if the $K' \geqq 1$, the steps S5 to S10 are repeated after the K' is displayed anew (step S12). If the $K'<1$, the "no toner" warning is given to the user (step S13) to prompt him to replace the cartridge.

Here, in the description given above, it is assumed that the number of printed sheets is counted to obtain information on the frequency of use of the cartridge, but it is equally possible to work out remaining printable sheets and indicate them on the display by measuring the driving period of the photosensitive drum or the application period of development bias as other sources of information.

In this way, the residual toner amount is directly detected by means 28 for detecting residual toner amounts accurately. After that, remaining printable sheets are worked out in accordance with information on the frequency of use of the cartridge. Therefore, it is possible to reliably calculate the remaining number of printable sheets only with small errors. Also, the remaining printable sheets are calculated in accordance with information stored in the memory means 60 provided for the cartridge. Therefore, even when a plurality of cartridges are used for one main body of an apparatus, detections can be executed accurately.

Here, for the first embodiment, the remaining printable sheets are worked out and indicated on the display using the consumed toner amount N, but it may be possible to indicate the residual toner amount in the cartridge by use of bar graphs or by changing colors of emitting light of LED. Further, it may be possible to indicate the remaining printable sheets or residual toner amount on the display on the host computer side.

Second Embodiment

Now, with reference to FIG. 6 and FIG. 7, a second embodiment will be described in accordance with the present invention.

Figure 6:
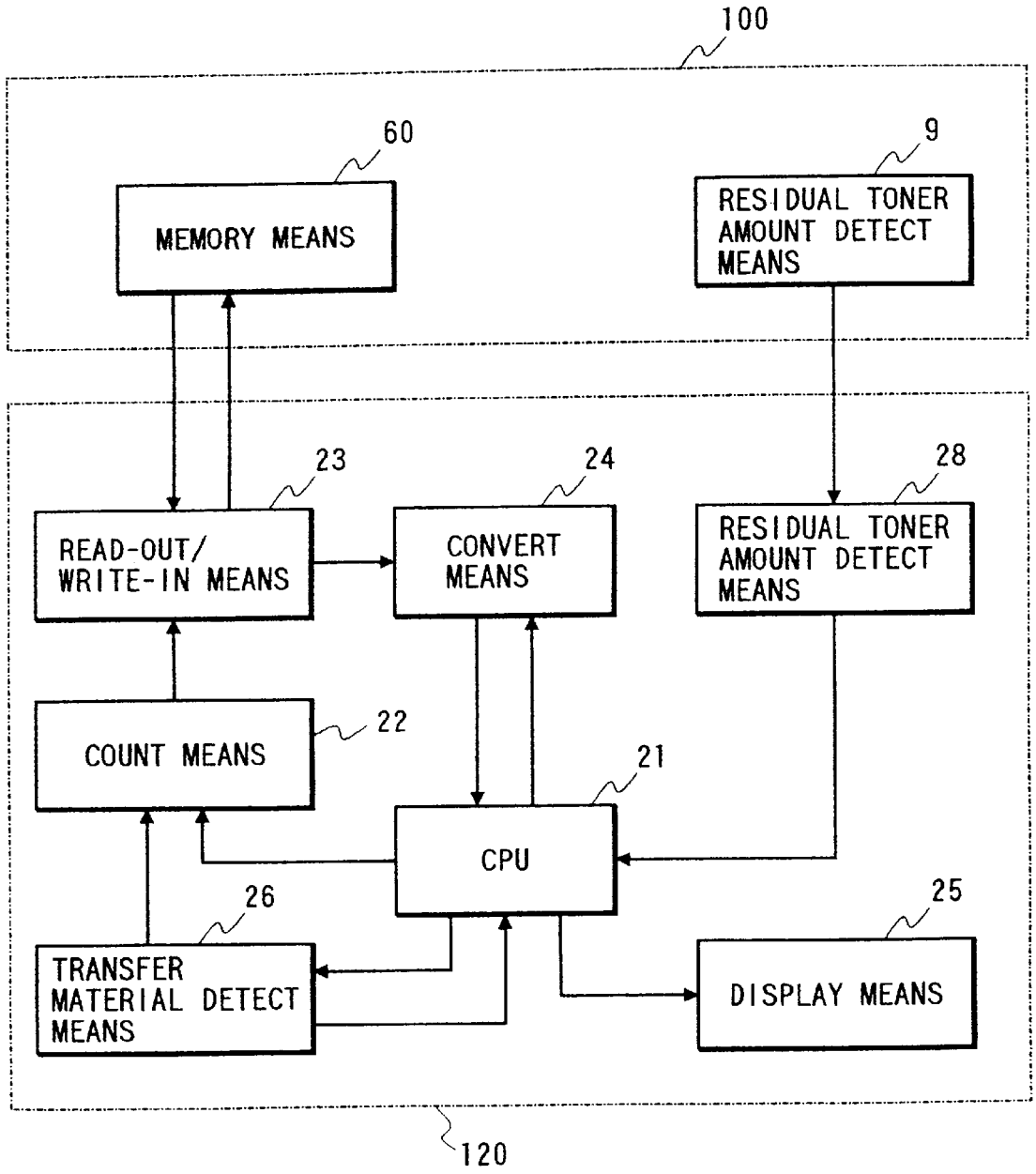
FIG. 6 is a block diagram illustrating the operation of an apparatus in accordance with a second embodiment of the present invention.
Figure 7:
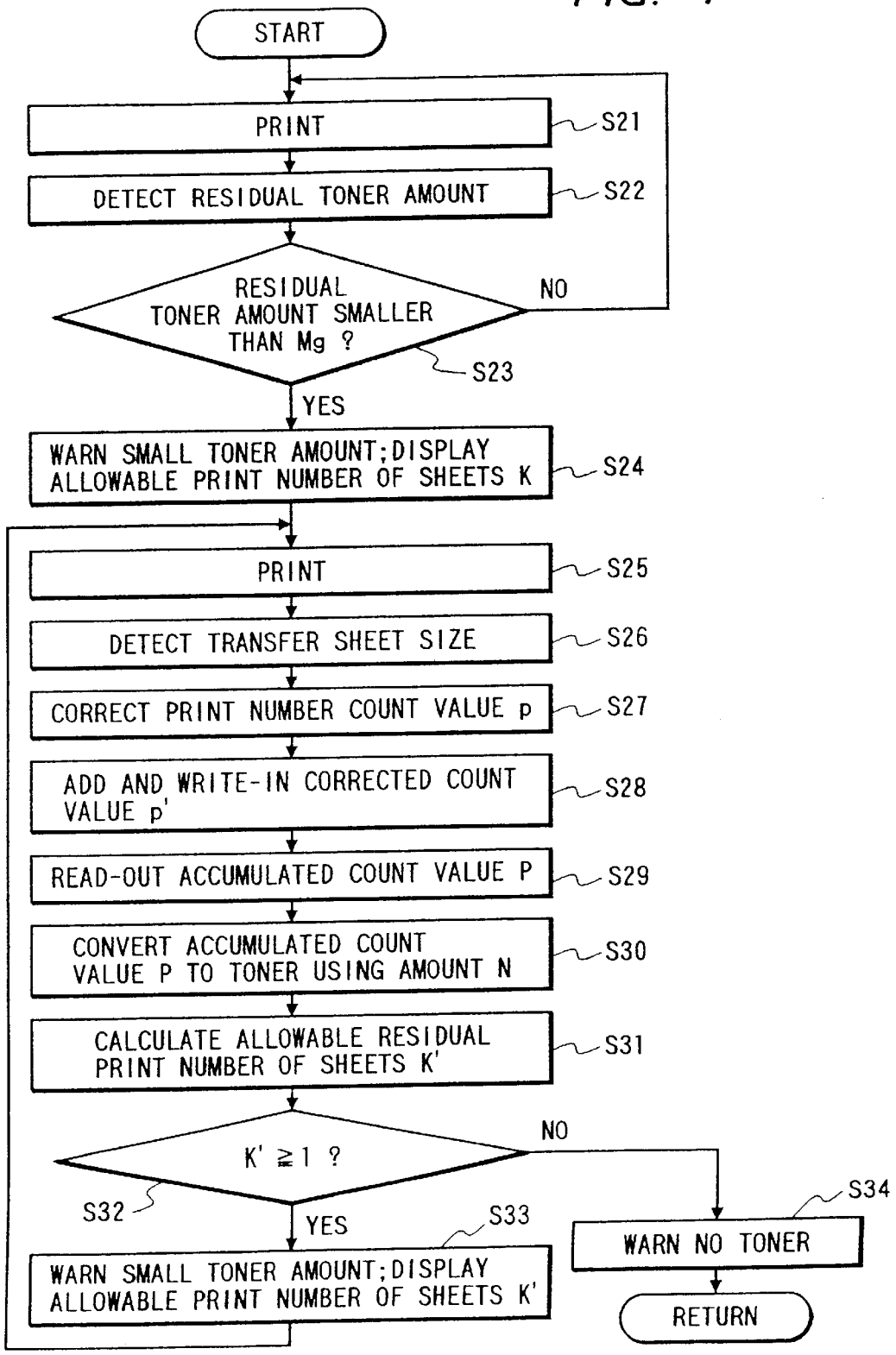
FIG. 7 is a flowchart illustrating the operation of the apparatus in accordance with the second embodiment.

FIG. 6 is a block diagram illustrating a mechanism to detect residual toner amounts for an electrophotographic image forming apparatus in accordance with the second embodiment. The features thereof are to detect the size of a transfer material for printing by means for detecting sizes of transfer material, and then, to correct the counted value of frequency of use for the execution of a more accurate detection. As means 26 for detecting transfer material, it may be possible to utilize a method, for example, whereby to arrange a sensor on a carrying path of the transfer material for the detection of the leading end and trailing end thereof, thus measuring its length from the leading end to the trailing end to determine the size of such transfer material.

In FIG. 6, when printing signal is transmitted from the CPU 21 in the main body of an apparatus to begin printing, the size of transfer material for printing is detected by means 26 for detecting the size of transfer material. The size of the transfer material thus detected is transferred to counting means 22. The counting means 22 corrects the value of frequency of use of the cartridge for printing in accordance with the size of the transfer material, and performs the intended counting. The counted value is additionally written to memory means in the cartridge one after another by read/write means 23. The counted value thus written to the memory means 60 is converted by conversion means 24 into the consumed toner amount, and transmitted to the CPU 21. The other structures shown in FIG. 6 are the same as those described in the first embodiment. Therefore, the description thereof will be omitted.

Now, with reference to a flowchart shown in FIG. 7, a description will be made of the flow of the actual operation in accordance with the second embodiment. For the description given below, the counted value of printed sheets is used as information on frequency of use as in the first embodiment.

At first, when printing is executed (step S21), the residual toner amount is detected by the residual toner amount detection circuit 28 (means for detecting residual toner amounts) (step S22) to determine whether or not toner is less than a given value of M gram (step S23). If it is determined that toner still remains more than M gram, the steps S21 to S23 are repeated.

If it is determined that toner has become less than M gram, a warning is given to the user to the effect that the residual toner amount is now small, and then, the remaining printable sheets K is worked out in terms of A4 size in accordance with the following formula (4) (step S24):

$$K(\text{sheets})=(M(g)-R(g))/S(g/\text{sheets}) \quad (4)$$

where S: Toner consumption per sheet at the standard printing rate in terms of A4 size;

R: An amount of toner on a limit where white void images appear due to insufficient amount of toner.

When printing is further executed after the residual toner amount is less than M gram (step S25), the size of the transfer material is detected at first by means 26 for detecting the sizes of transfer material (step S26), and then, the value p of printed sheets is corrected (step S27). This correction of counted value is made in accordance with the ratio of the areas of transfer materials. For example, while defining the counted value as 1 for a printed A4-sized sheet, it is defined as 0.5 for a printed A5-sized sheet. The counted value p' thus corrected is written to the memory means 60 additionally (step S28). The counted value P written to the memory means 60 is read out to the main body of the apparatus again (step S29), and then, as in the first embodiment, it is converted by conversion means 24 into a consumed toner amount N in accordance with the following formula (5) (step S30):

$$N(g)=P(\text{sheets})\times L(g) \quad (5)$$

where L: A standard amount of toner to be consumed per unit frequency of use.

Using the consumed toner amount N converted from the counted value, and the residual toner amount defined by means for detecting residual toner amounts, that is, by use of the residual toner amount detection circuit 28, a calculation is made to obtain remaining printable sheets K' in terms of A4 in accordance with the following formula (6) (step S31):

$$K'(\text{sheets})=(M(g)-N(g)-R(g))/S(g/\text{sheets}) \quad (6)$$

Here, the value of K' is examined (step S32). If the $K' \geqq 1$, the K' is indicated on the display anew (step S33), and then, the steps S25 to S32 are repeated. On the other hand, if $K'<1$, a warning of "no toner" is given to the user (step S34) to prompt him to replace the cartridge.

In this way, the residual toner amount is directly detected by means 28 for detecting residual toner amounts. After that, the remaining printable sheets are worked out in accordance with information on the frequency of use of the cartridge. Therefore, it is possible to calculate the remaining printable sheets more accurately.

Third Embodiment

Now, with reference to FIG. 8 and FIG. 9, a third embodiment will be described in accordance with the present invention. The features of this embodiment are to additionally store information on the frequency of use from the initial stage, and then, when it is determined by means for detecting residual toner amounts, namely, by use of the residual toner amount detection circuit 28, that toner is now less than a given value, a calculation is made on the basis of the information on the frequency of use up to that moment to obtain a value. The value thus calculated is used for converting the information on the following frequency of use into the amount of toner consumption to follow.

In general, an amount of adhering toner as an actual image tends to vary due to various factors even when one and the same image is printed. More specifically, the variations of constituents of a cartridge, the user's operational environment, the variations of parts used for the main body of an apparatus, and the like, may result in a fine difference in the amounts of adhering toner in some cases. However, in accordance with the third embodiment, the required correction coefficient is worked out on the basis of information on the cartridge to be used actually at the user's site, thus making it possible to correct such factors that cause variations as described above, and to execute the intended detection more accurately.

Figure 8:
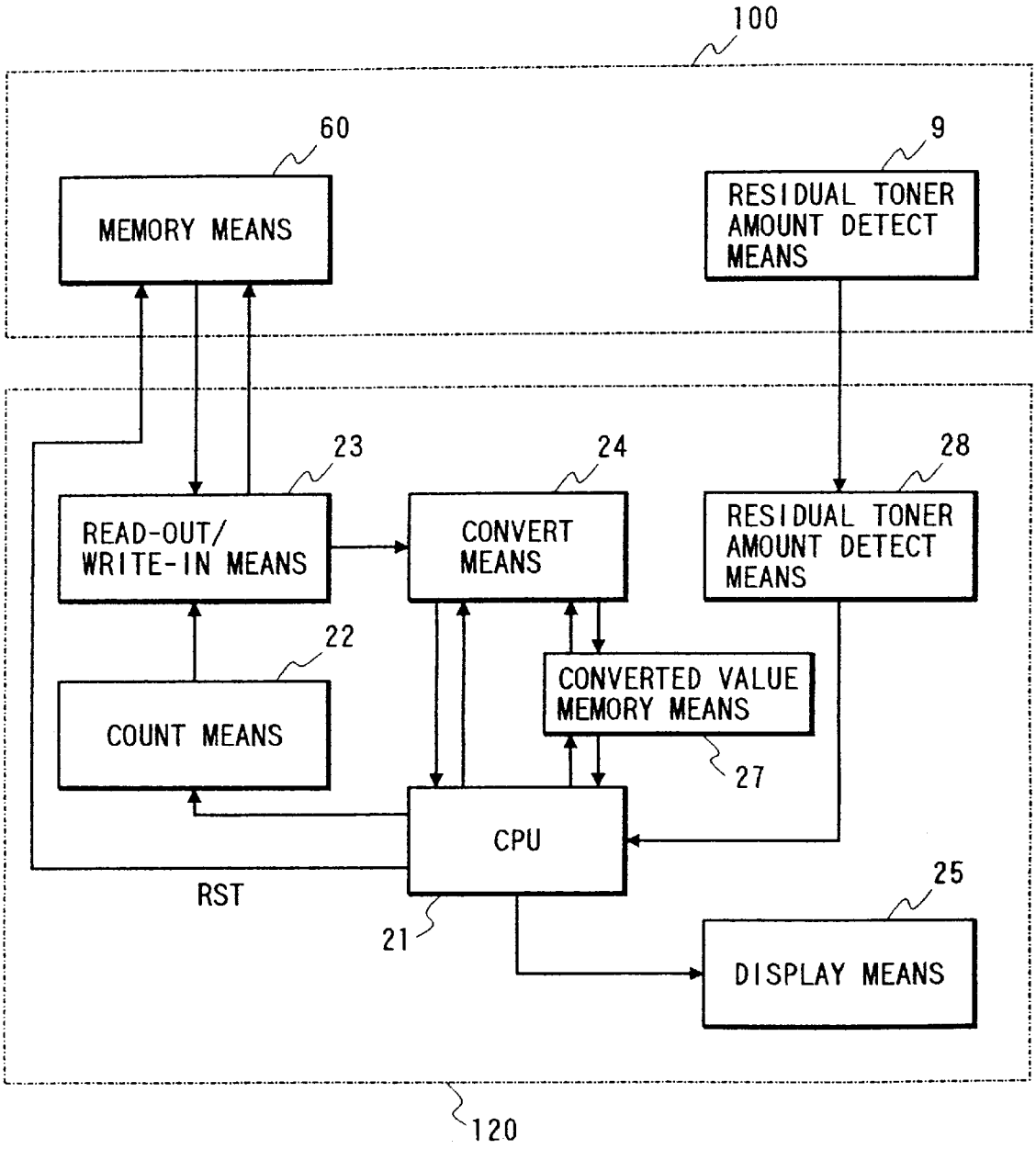
FIG. 8 is a block diagram illustrating the operation of an apparatus in accordance with a third embodiment of the present invention.
Figure 9:
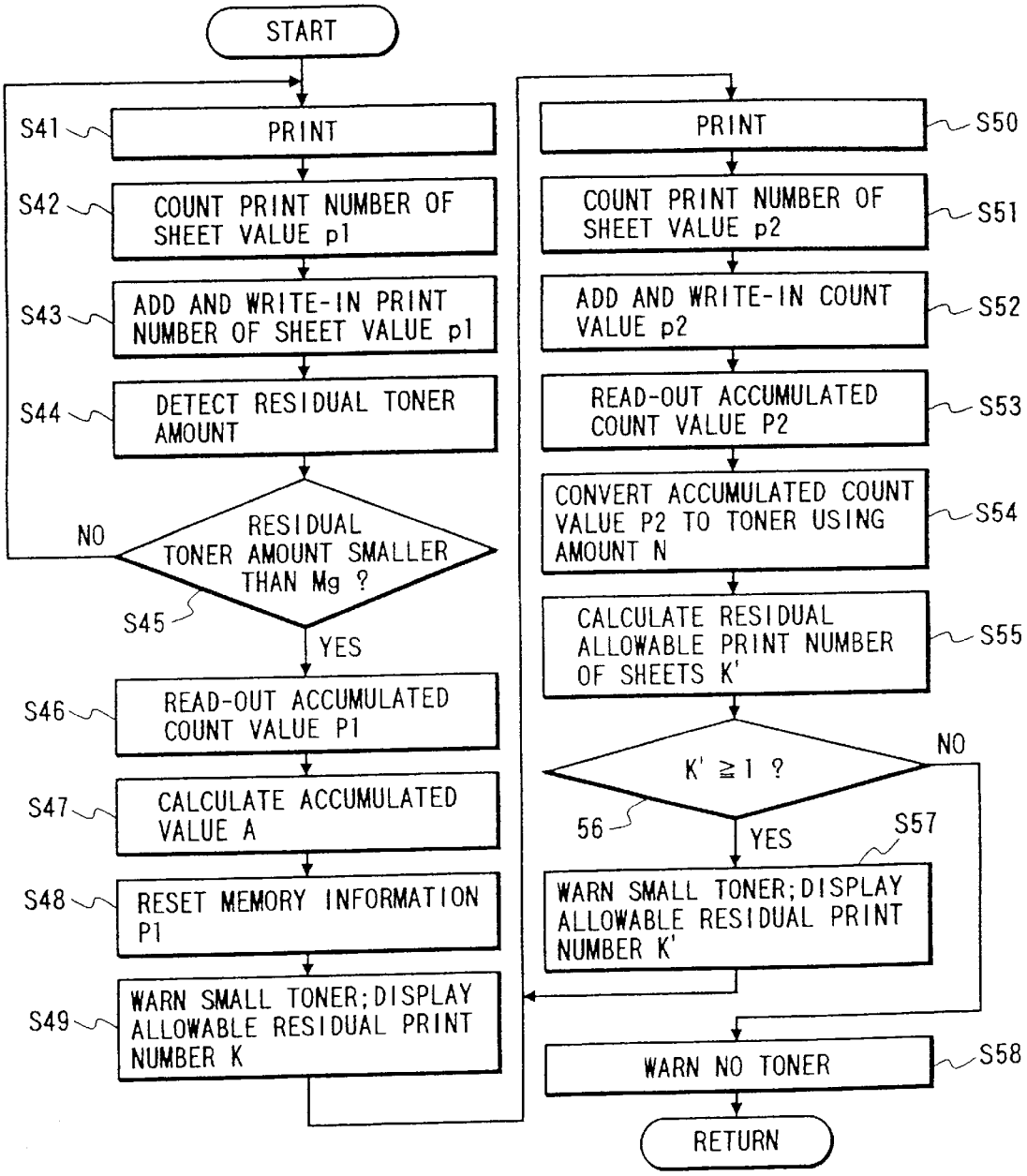
FIG. 9 is a flowchart illustrating the operation of the apparatus in accordance with the third embodiment.

FIG. 8 is a block diagram illustrating a mechanism to detect residual toner amounts for an electrophotographic image forming apparatus in accordance with the third embodiment.

The counted value of the frequency of use of a cartridge, which is additionally stored in memory means 60 from the initial stage until the residual toner amount to be found less than a given value, is read out by read/write means 23, and then, by conversion means 24, the converted value is obtained. After that, the counted value on the memory means 60 is reset by means of a resetting signal RST from the CPU 21, and the frequency of use of the cartridge is counted anew after the residual toner amount has become less than a given value. The functions of other parts in the block diagram shown in FIG. 8 are the same as those described in the first embodiment. Therefore, the description thereof will be omitted.

Now, with reference to a flowchart shown in FIG. 9, a description will be made of the flow of actual operation in accordance with the third embodiment. In this respect, the counted value of printed sheets is used as information on the frequency of use as in the first embodiment.

At first, when printing is executed (step S41), a value p1 of printed sheets is counted (step S42), which is additionally written to memory means one after another (step S43). Then, the residual toner amount is detected by the residual toner amount detection circuit (step S44) to determine whether or not the residual toner amount is less than a given value of M gram (step S45).

Here, if it is determined that toner still remains more than M gram, the steps 41 to 45 are repeated. On the other hand, if it is determined that the residual toner amount is less than M gram, the counted value P1 of printed sheets up to that moment is read out to the main body at first (step S46), and then, a converted value A is worked out in accordance with the following formula (7) (step S47):

$$A(g/\text{sheets})=(V(g)-M(g))/P1 \quad (7)$$

where V(g): An amount of toner filled in a cartridge at the time of delivery.

Then, the counted value P1 stored in the memory means 60 is reset by the CPU 21 (step S48). After that, a warning is given to the user to the effect that remaining toner is now small, and then, on the basis of the converted value A, a remaining printable sheets K is indicated on the display in accordance with the following formula (8) (step S49):

$$K(\text{sheets})=(M(g)-R(g))/A(g/\text{sheets}) \quad (8)$$

where R: An amount of toner on a limit where white void images appear due to the insufficient toner.

When printing is further executed (step S50), the value p2 of printed sheets is again counted (step S51), which is additionally written to the memory means 60 anew after the memory means 60 has been reset (step S52). The counted value P2 of the printed sheets written to the memory means 60 is again read out to the main body 120 of the apparatus (step S53), and then, converted into a consumed toner amount of N gram using the converted value N in accordance with the following formula (9) (step S54):

$$N(g)=P2\times A(g/\text{sheets}) \quad (9)$$

Then, using the consumed toner amount N converted from the counted value, and the residual toner amount M defined by the residual toner amount detection circuit 28, a calculation is made to obtain the remaining printable sheets K' in accordance with the following formula (10) (step S55):

$$K'(\text{sheets})=(M(g)-N(g)-R(g))/A(g/\text{sheets}) \quad (10)$$

Here, the value K' is examined (step S56). If the K'≧1, the K' is indicated anew on the display (step S57), and the steps S50 to S57 are repeated. On the other hand, if the K'<1, the "no toner" warning is given to the user (step S58) to prompt him to replace the cartridge.

In this way, the counted value of the frequency of use from the initial stage, and means 28 for detecting residual toner amounts are utilized for the correction of variation of adhering toner resulting from the varied constituent of the cartridge itself, the main body of an apparatus, the environments under which it is used, and the like, hence making it possible to calculate remaining printable sheets more accurately. Also, the structure is arranged so that when the residual toner amount, which is detected by means 28 for detecting residual toner amounts, indicates that it is less than a given value, information on the preceding counted value stored on the memory means 60 is reset, and then, information thereafter is stored anew. However, if the storage capacity of memory means 60 has a more room, it may be possible to arrange a structure so that information on the counted value before the residual toner amount arrives at a given value, and information on the counted value after it has arrived at the given value can be stored in the memory means separately.

Fourth Embodiment

Figure 10:
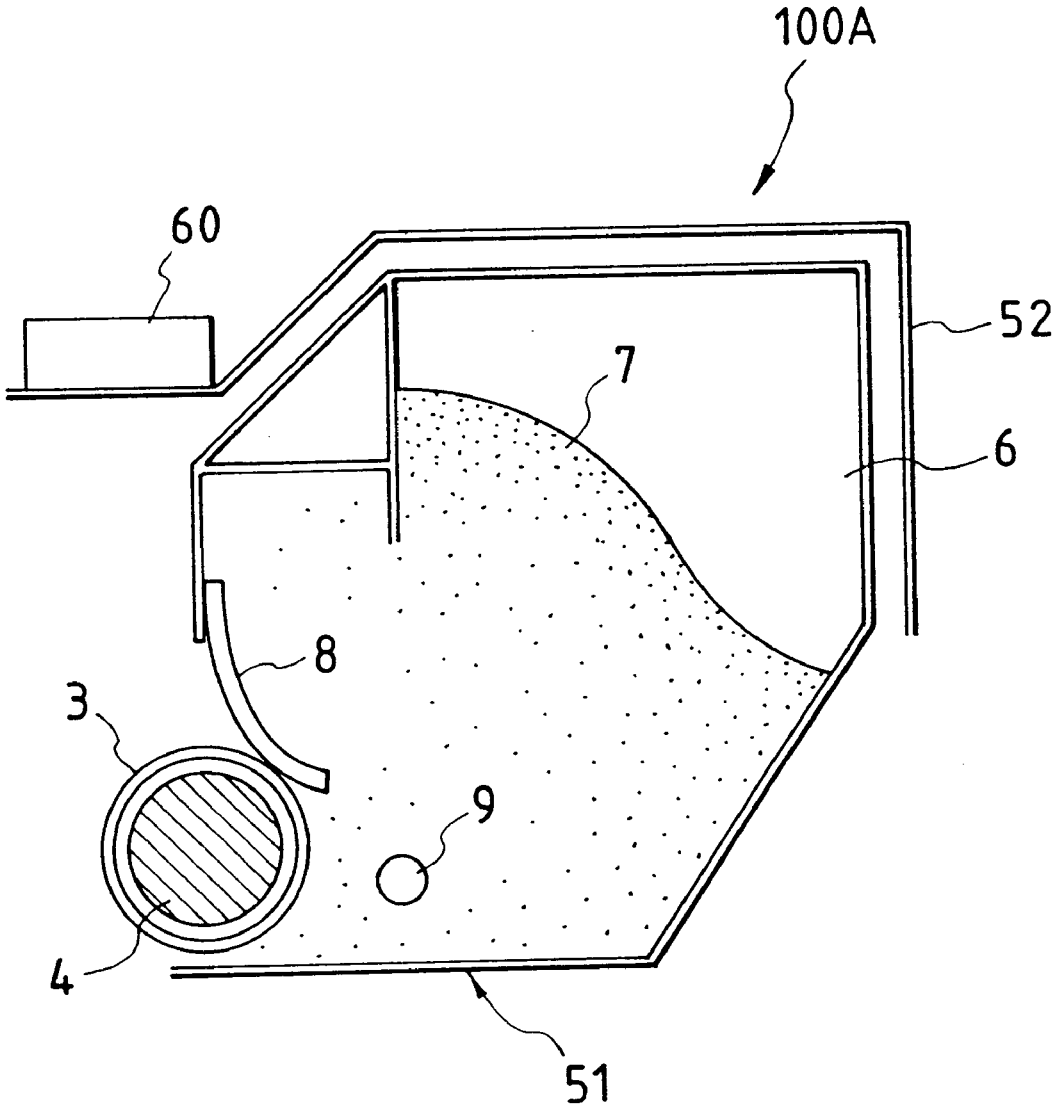
FIG. 10 is a side sectional view showing a development device in accordance with a fourth embodiment of the present invention.

FIG. 10 shows a variation of a cartridge type development device 100A.

The development device 100A of the present embodiment is arranged to be a cartridge by integrally forming in a plastic frame 52 a development sleeve 3, which serves as development means, and a developer container 6 having toner 7 therein to supply it to the development sleeve 3. Also, in the development device 100A, a development blade 8 and means 9 for detecting residual toner amounts in the developer container 6 are arranged, while a magnet 4 is fixed in the development sleeve 3. In other words, the development device 100A can be regarded as a cartridge, which is formed by removing the photosensitive drum 1, charging means 2, and cleaning means 5 from among those constituting the process cartridge 100 described in the first embodiment. Also, memory means 60 is provided for the development device 100A in accordance with the fourth embodiment. These means 9 for detecting residual toner amounts, means 28 for detecting residual toner amounts, memory means 60, and others function in the same way as described in the first, second and third embodiments. Therefore, regarding the structures of these means and functions, reference is made to each of the respective descriptions as set forth in these embodiments.

Fifth Embodiment

Now, with reference to FIG. 11 and FIG. 12, a description will be made of the operation of residual toner amount detection in accordance with a fifth embodiment of the present invention. In this respect, the fifth embodiment will be described by exemplifying an electrophotographic image forming apparatus of the so-called reverse development system where toner adheres to the laser irradiated portion of an electrophotographic photosensitive element.

Figure 11:
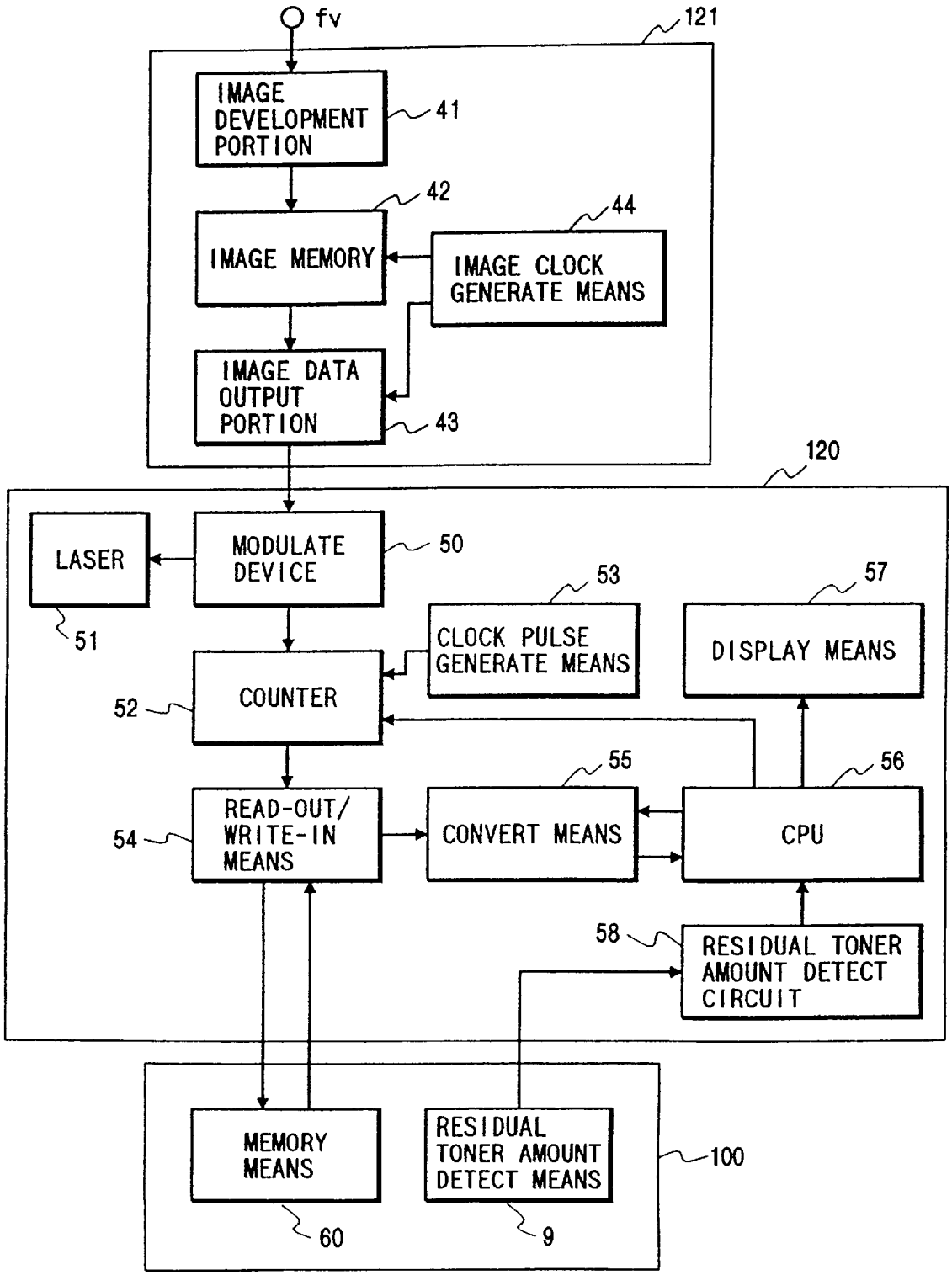
FIG. 11 is a block diagram illustrating the operation of an apparatus in accordance with a fifth embodiment of the present invention.
Figure 12:
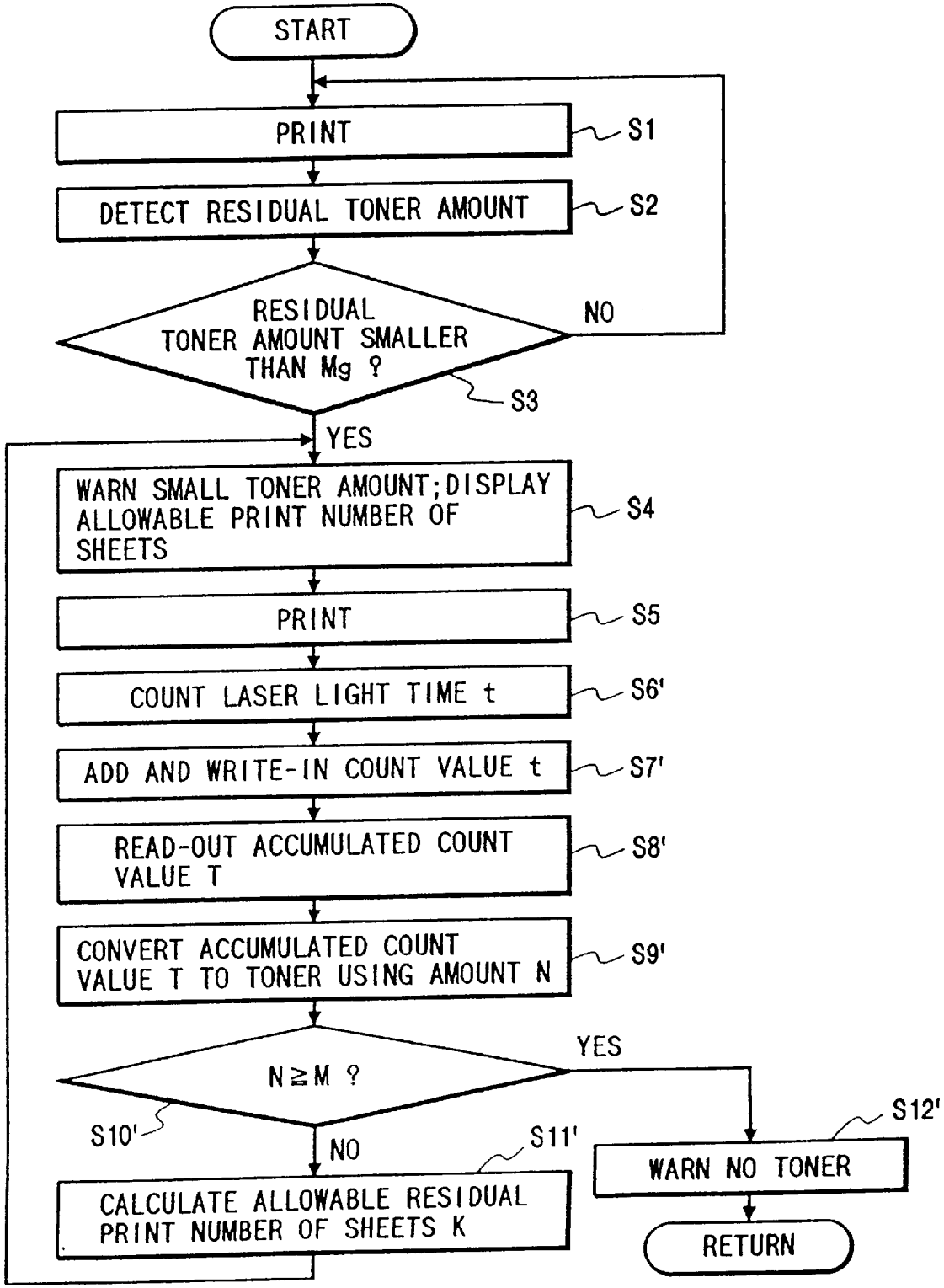
FIG. 12 is a flowchart illustrating the operation of the apparatus in accordance with the fifth embodiment.

FIG. 11 is a block diagram illustrating a mechanism to detect residual toner amounts in an electrophotographic image forming apparatus in accordance with the fifth embodiment, in which are described a cartridge 100, the main body 120 of an electrophotographic image forming apparatus, and a controller 121 for transforming printing data into printing signals. For the cartridge 100, means 9 for detecting residual toner amounts and memory means 60 are provided, while for the main body 120 of an electrophotographic image forming apparatus, means for detecting residual toner amounts, that is, residual toner amount detection circuit 58, is provided.

In accordance with the fifth embodiment, as information on the printed value, the emission period of laser is counted, and the counted value is stored in the memory means 60 in the cartridge as temporal information. Printing data fv from a host computer (not shown) or the like are inputted into the controller 121, and developed into dot data by means of an image development unit 41. The printing data thus developed are once stored in image memory 42. After that, such data are transmitted to the main body 120 of the electrophotographic image forming apparatus by means of image data output unit as serial image signals. Here, a reference numeral 44 designates means for generating image clocks.

The image signal thus transmitted to the main body 120 are modulated by a modulator 50 into the laser input voltage that turns on and off laser 51 in accordance with the image signals fv. In other words, the laser 51 is connected with the modulator 50, and then, irradiate laser in accordance with the modulated signals. Also, the modulator 50 is connected with a counter 52, and by means of the counter 52, the output period from the modulator 50 to the laser 51 is measured, that is, a temporal information is measured corresponding to the exposure time of the laser beam that is output from the laser 51 to the photosensitive drum 1. In other words, means 53 for generating clock pulses such as a crystal oscillator is connected with the counter 52, which uses as the temporal information the counted value of clock pulse numbers received while laser emission signals continue. Here, the measured clock pulse numbers are additional written by read/write means 54 to the memory means 60 in the cartridge one after another.

In accordance with the fifth embodiment, the laser exposure time is counted directly using clock pulse numbers. For example, therefore, it is also possible to utilize multivalued signals as image signals whereby to make the laser beam emission period longer for one dot pixel for the higher densified area of an image, while making it shorter for one dot pixel for the intermediately densified area of an image.

The temporal information written on the memory means 60 is again read out by read/write means 54 to the main body 120 of the electrophotographic image forming apparatus, and transferred to conversion means 55. The conversion means 55 is connected with the CPU 56, thus working out a consumed toner amount on the basis of each amount of toner consumption per unit time prepared in advance in the CPU 56. The consumed toner amount thus calculated is transferred to the CPU 56, and then, in the CPU 56, the remaining printable sheets are calculated and informed to the user through display means 57.

Now, with reference to a flowchart shown in FIG. 12, a description will be made of the flow of actual operation in accordance with the fifth embodiment.

At first, when printing is executed (step S1), the residual toner amount is detected by means for detecting residual developer amounts, that is, by use of the residual toner amount detection circuit 28 (step S2), thus determining whether or not toner becomes less than a given value (step S3). For the present embodiment, the residual toner amount detection circuit is set so that the residual toner amount is interpreted as being less than a given value when a residual toner amount becomes less than the M gram to be expressed by the following formula (11):

$$M(g)=500\times S(g/\text{sheets})+R(g) \tag{11}$$

where S: An amount of toner consumption per sheet at the standard printing rate;

R: An amount of toner on a limit where which void images appear due to insufficient toner.

In accordance with the fifth embodiment, if it is determined that toner still remains in an amount of more than M gram, the steps S1 to S3 are repeated. If it is determined that the residual toner amount becomes less than M gram, the user is warned to the effect that the residual toner amount is now small. Then, it is indicated on the display that the remaining printable sheets are 500 at the standard printing rate (step S4). The printable sheets can be arbitrarily selected depending on the decision level of the residual toner amount detection circuit 28 as described earlier. When printing is further executed (step S5), the counted value t of clock pulses is measured corresponding to the emission period of laser for printing (step S6'), and additionally written by read/write means 24 on the memory means 60 (step S7'). The accumulated value T of the counted value t of the clock pulses written to the memory means 60 is read out again to the main body 120 (step S8'), and then, converted by conversion means 25 into the consumed toner amount N gram in accordance with the following formula (12) (step S9'):

$$N(g)=T\times L(g) \tag{12}$$

where L: A standard amount of toner to be consumed per unit count.

Then, the consumed toner amount N converted from the counted value and the residual toner amount M set by the residual toner amount detection circuit 28 are compared (step S10'). If the N<M, the remaining printable sheets K are worked but in the following formula, and after indicating it on the display anew (step S11'), the step S5 to S10' are repeated:

$$K(\text{sheets})=(M(g)-N(g))/S(g/\text{sheets}) \tag{13}$$

If the N≧M, the "no toner" warning is given to the user (step S12') to prompt him to replace the cartridge.

In this way, after the residual toner amount is directly detected accurately by means for detecting residual toner amounts, that is, by use of the residual toner amount detection circuit 58, the remaining printable sheets are worked out on the basis of the information on the accumulatively calculated information on image printing rate. Therefore, it becomes possible to calculate the remaining printable sheets more accurately than the conventional case where the consumed amount of toner is accumulated from the initial stage by means of calculation only on the basis of the information on the printing rate. Also, since the remaining printable sheets are worked out in accordance with the information stored in the memory means 60 in the cartridge 100, it is possible to execute detections accurately even when a plurality of cartridges are used for one main body of an apparatus.

Here, for the fifth embodiment, the description has been made of the so-called reverse development system where toner adheres to the laser exposure portion of an electrophotographic photosensitive element, but by counting the non-laser emission period by use of the same means, it is also possible to apply the present invention to the regular development system where toner adheres to the portion having no laser emission on it. Also, the remaining printable sheets are calculated in accordance with the consumed toner amount N, but it may be possible to indicate on the display the residual toner amount in a cartridge by the representation of bar graphs or by changing the emitted colors of LED. Further, through an interface, it may be possible to represent the remaining printable sheets or the residual toner amount on the host computer side.

Sixth Embodiment

Now, with reference to FIG. 13 and FIG. 14, a sixth embodiment will be described in accordance with the present invention.

Figure 13:
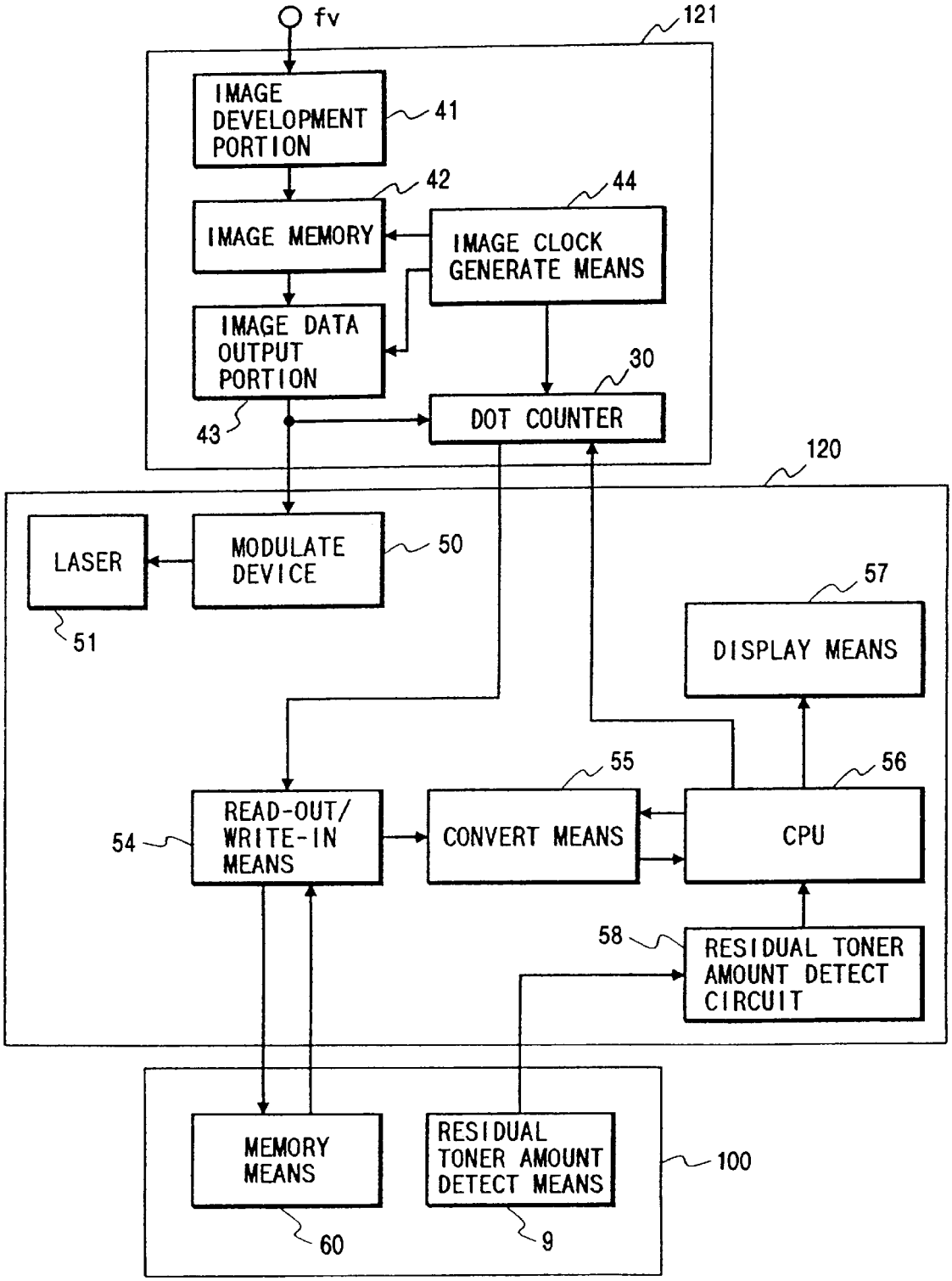
FIG. 13 is a block diagram illustrating the operation of an apparatus in accordance with a sixth embodiment of the present invention.
Figure 14:
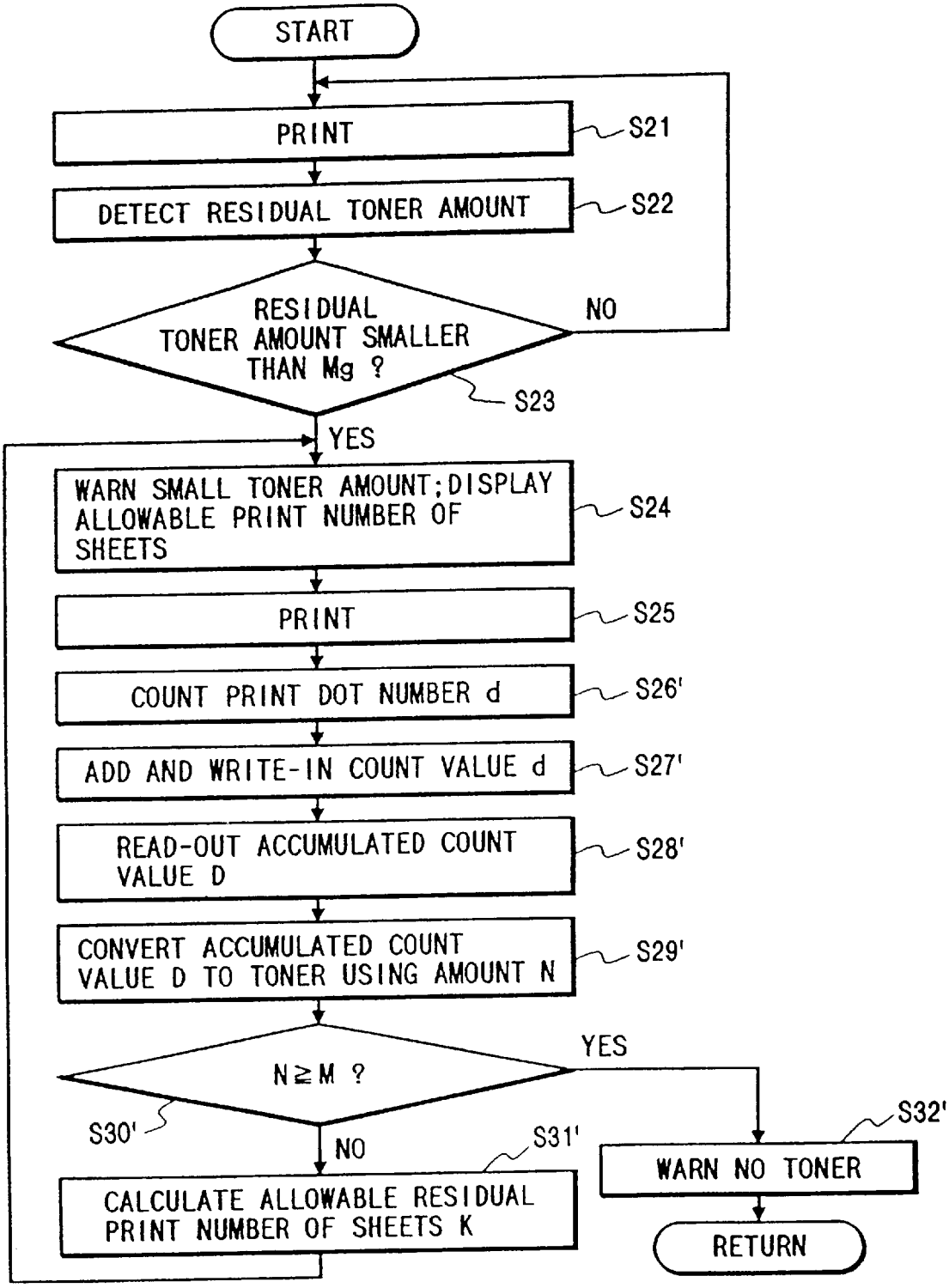
FIG. 14 is a flowchart illustrating the operation of the apparatus in accordance with the sixth embodiment.

FIG. 13 is a block diagram showing the present embodiment. The features thereof are to count the dot numbers developed for an image in a controller 121 as information on a printed value, and then, to store the counted value in memory means 60 in the cartridge 100.

When printed dot numbers are counted, it is impossible to make image signals multiple by changing duties of laser emission period as described in the fifth embodiment. However, it should be good enough to count printing dot numbers as they are in accordance with the image signals and the image clock signals. Therefore, it is unnecessary to arrange any individual means 53 (see FIG. 11) for generating clock pulses in the main body 120 of an apparatus. This contributes to making the circuit structure simpler to bring about an advantage in costwise.

In FIG. 13, a dot counter 30, which is arranged in the controller 121, measures dot numbers to be recorded as an image by means of serial image signals and signal clocks that are output from the image data output unit 43. The counted value of printing dot numbers thus measured are transferred to the main body 120 of an electrophotographic image forming apparatus, and additionally written by read/write means 54 to the memory means 60 in the cartridge one after another. The counted value thus written to the memory means 60 are converted by conversion means 55 into an consumed toner amount and transferred to the CPU 56. In FIG. 13, all other structures are the same as like-named structures described in the first embodiment. Therefore, the description thereof will be omitted.

Now, with reference to a flowchart shown in FIG. 14, the description will be made of the flow of the actual operation in accordance with the present embodiment.

At first, when printing is executed (step S21), the residual toner amount is detected by means for detecting residual developer amounts, that is, by use of the residual toner amount detection circuit 28 (step S22), thus determining whether or not toner becomes less than a given value (step S23). For the sixth embodiment, the residual toner amount detection circuit 28 is set so that the residual toner amount is determined as being less than a given value when a residual toner amount becomes less than the M gram expressed by the following formula (14) as in the first embodiment:

$$M(g)=500\times S(g/\text{sheets}) \tag{14}$$

where S: An amount of toner consumption per sheet at the standard printing rate.

Here, if toner is determined to be still remaining in an amount of more than M gram, the steps S21 to S23 are repeated. If it is determined that the residual toner amount becomes less than M gram, the user is warned to the effect that the residual toner amount is now small. Then, it is indicated on the display that the remaining printable sheets are 500 at the standard printing rate (step S24). When printing is further executed (step S25), the counted value d of printed dot numbers for printing is measured (step S26'), and additionally written to the memory means 60 (step S27'). The accumulated value D of the counted value d of the printed dot numbers written to the memory means 60 is read out again to the main body 120 (step S28'), and then, converted by conversion means 25 into the consumed toner amount N gram in accordance with the following formula (15) (step S29'):

$$N(g)=D\times J(g) \tag{15}$$

where J: A standard amount of toner to be consumed per unit count.

Then, using the consumed toner amount N converted from the counted value and the residual toner amount M set by the residual toner amount detection circuit 28 are compared (step S30'). If the N<M, the remaining printable sheets K are worked out in the following formula (16) as in the first embodiment, and after indicating it on the display anew (step S31'), the steps S24 to S31' are repeated:

$$K(\text{sheets})=(M(g)-N(g))/S(g/\text{sheets}) \tag{16}$$

Here, if the N≧M, the "no toner" warning is given to the user (step S32') to prompt him to replace the cartridge.

In this way, printed dot numbers are counted as information on the printed amount, thus making it possible to simplify the circuit structure to calculate remaining printable sheets.

Here, for the sixth embodiment, the dot counter 30 is arranged in the controller 121, but it may be possible to utilize a structure where a counter 30 is provided for the main body of an apparatus with an arrangement that image clock signals are transmitted to the main body 120 of the apparatus.

Seventh Embodiment

Figure 15:
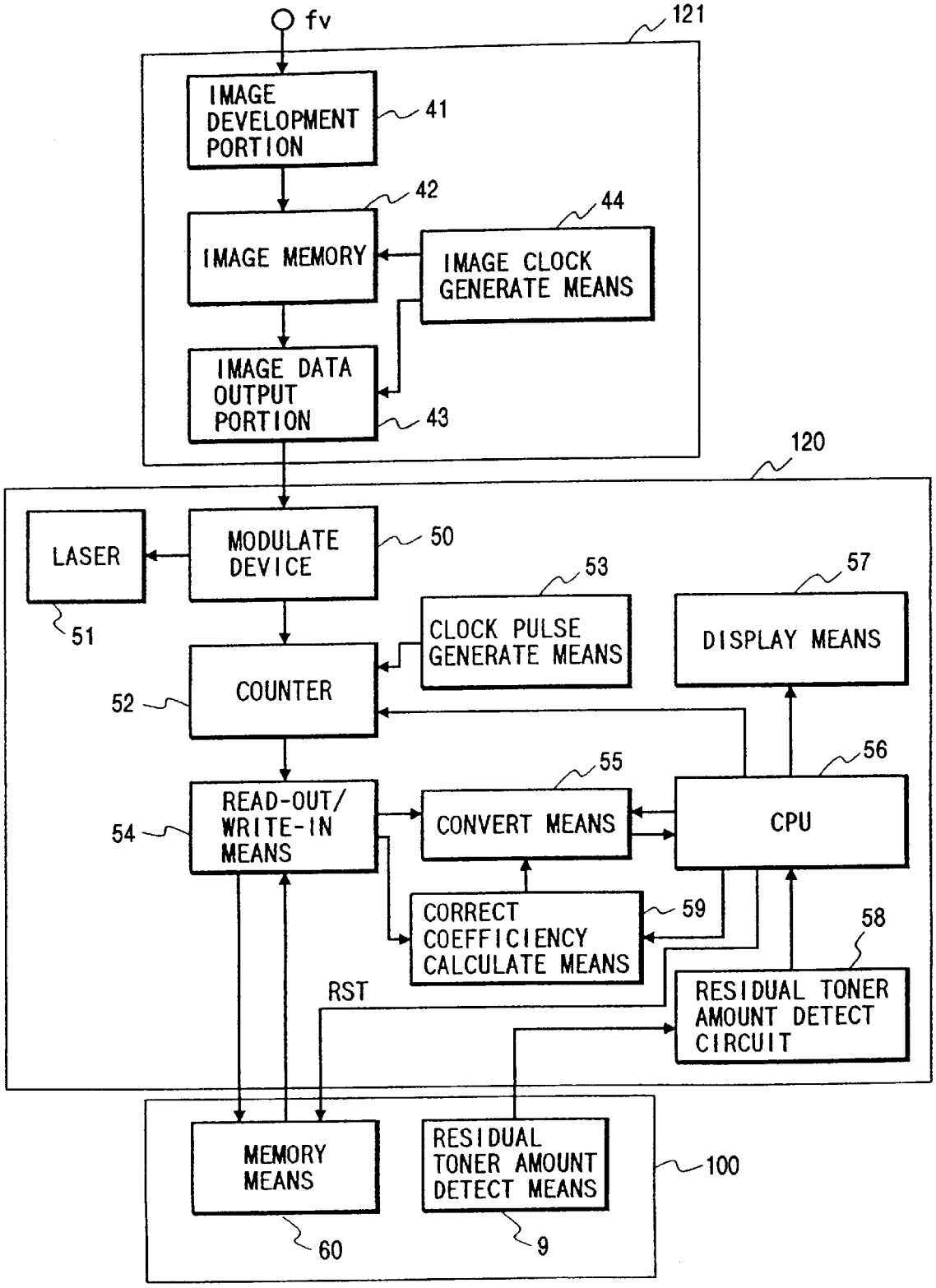
FIG. 15 is a block diagram illustrating the operation of an apparatus in accordance with a seventh embodiment of the present invention.
Figure 16:
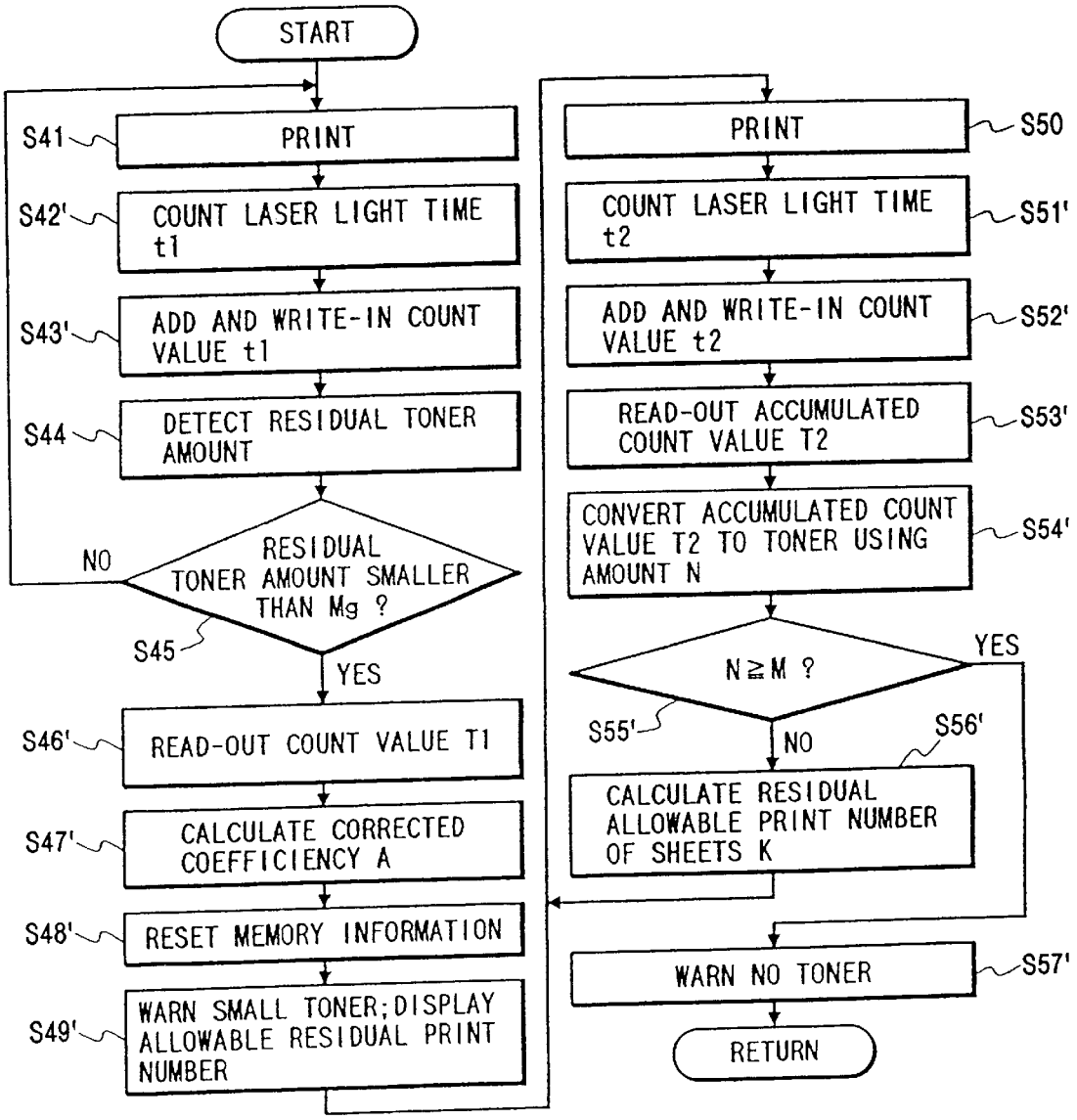
FIG. 16 is a flowchart illustrating the operation of the apparatus in accordance with the seventh embodiment.

With reference to FIG. 15 and FIG. 16, a seventh embodiment will be described in accordance with the present invention.

The features of the seventh embodiment are to accumulate information on the amounts of print that correspond to the printed amounts from the initial stage, and then, when it is determined by means of residual toner amount detection circuit 58 that toner has become less than a given amount, a correction coefficient is worked out, which is used for converting information on printing amount into the amount of toner to be consumed thereafter in accordance with the accumulated value of information on printed amounts up to that moment.

In general, an amount of adhering toner as an actual image tends to vary due to various factors even when one and the same image is printed. More specifically, the variations of constituents of a cartridge, the user's operational environment, the variations of parts used for the main body of an apparatus, and the like, may result in fine difference in the amounts of adhering toner in some cases. However, in accordance with the present embodiment, the required correction coefficient is worked out on the basis of information on the cartridge to be used actually at the user's site. Therefore it is possible to correct such factors that may cause variations as described above, thus executing the intended detection more accurately.

FIG. 15 is a block diagram showing the seventh embodiment, in which the counted value of laser emission period is used as information on the amounts of prints that correspond to the printed amount as in the fifth embodiment.

In FIG. 15, the counted value of laser emission period, which is accumulated and stored on memory means 60 from the initial stage until a detected residual toner amount becomes less than a given value, is read out by read/write means 54, and then a correction coefficient is worked out by means 59 for use of calculating correction coefficients. After that, the counted value, which is stored in the memory means, is reset by means of resetting signal RST from the CPU 56. Then counted value of laser emission period is accumulated anew after the residual toner amount becomes less than a given value. In FIG. 15, functions of all other parts are the same as like-named parts described in the first embodiment. Therefore, the description thereof will be omitted.

Now, with reference to a flowchart shown in FIG. 16, the description will be made of the flow of the actual operation in accordance with the seventh embodiment.

At first, when printing is executed (step S41'), the counted value t of clock pulses corresponding to the laser emission period for printing is measured (step S42'), and additionally written on the memory means 60 (step S43'). Then, a residual toner amount is detected by means for detecting residual developer amounts, that is, the residual toner amount detection circuit 23 (step S44'), thus determining whether or not toner becomes less than a given value (step S45). For the present embodiment, the residual toner amount detection circuit 28 is set so that the residual toner amount is determined as being less than a given value when a residual toner amount becomes less than the M gram expressed by the following formula (17) as in the first embodiment:

$$M(g)=500\times S(g/\text{sheets})+R(g) \tag{17}$$

where S: An amount of toner consumption per sheet at the standard printing rate;

R: An amount of toner on a limit where white void images appear due to insufficient toner.

Here, if toner is determined to be still remaining in an amount of more than M gram, the steps S41 to S45 are repeated. If it is determined that the residual toner amount becomes less than M gram, the accumulated value T1 of counted value of clock pulses up to that moment is at first read out into the main body of an apparatus (step S46'), and the correction coefficient A is worked out in accordance with the following formula (18) (Step S47'):

$$L'(g)=(V(g)-M(g))/T1 \tag{18}$$

(V(g): An amount of toner filled in a cartridge at the time of deliver)

$$A=L'/L \tag{19}$$

(L(g): An amount of toner to be consumed per unit count, which is defined in a CPU in advance).

Then, the accumulated value T1 in the memory means 60 is reset by the CPU 26 (step S48').

Subsequently, the user is warned to the effect that the residual toner amount is now small, with the indication on the display that the remaining printable sheets are 500 at the standard printing rate (step S49'). When printing is further executed (step S50), the counted value t2 of clock pulses corresponding to the laser emission period for printing is measured (step S51'), and additionally written on the memory means 60 after it has been reset (step S52'). The accumulated value T2 of the counted value t2 of clock pulses written on the memory, means 60 is read out again to the main body 120 (step S53'), and converted into the consumed toner amount N gram corrected by the correction coefficient A in accordance with the following formula (20) (step S54'):

$$N(g)=(T2\times L(g))\times A \tag{20}$$

Here, using the consumed toner amount N converted from the counted value and the residual toner amount M set by the residual toner amount detection circuit 28 are compared (step S54'). If the N<M, the remaining printable sheets K are worked out in the following formula (21), and after indicating it on the display anew (step S56'), the steps S49' to S55' are repeated:

$$K(\text{sheets})=(M(g)-N(g))/S(g/\text{sheets}) \tag{21}$$

Here, if the N≧M, the "no toner" warning is given to the user (step S57') to prompt him to replace cartridges.

In this way, the accumulated value of information on the printed value from the initial state, and means 28 for detecting residual toner amounts are utilized for correcting the variations of toner adhesion resulting from the various factors, such as the states of a cartridge itself, the main body of an apparatus, the environment under which an apparatus is used. Therefore, it is possible to calculate remaining printable sheets more accurately.

Here, in accordance with the seventh embodiment, the counted value of laser emission period is used as information on the amounts of prints that correspond to the printed amounts, but it may be possible to utilize other information obtainable by counting dot numbers or the like in the same conception as described above.

What is claimed is:

1. An image forming apparatus for forming images on a recording material, comprising:

an electrophotosensitive member;

developing means for developing a latent image formed on said electrophotosensitive member using a developing agent;

a developing agent container for containing the developing agent;

a memory for storing information with respect to an amount of consumption of the developing agent;

computing means for computing a number of printable recording materials in accordance with the information with respect to the amount of consumption of the developing agent and consumption rate information of the developing agent; and information output means for outputting information of the number of printable recording materials computed by said computing means.

2. An apparatus according to claim 1, wherein the information with respect to the amount of consumption of the developing agent includes at least one of a number of printed recording materials, a driving time of said electrophotosensitive member, an amount of an image information, and a time for which a voltage for developing is applied to said developing means.

3. An apparatus according to claim 1, wherein said developing agent container and said memory are made into a single unit, which is detachably mountable to a main body of said image forming apparatus.

4. An apparatus according to claim 1, wherein said developing agent container, said memory, said electrophotosensitive member, and said developing means are made into a single unit, which is detachably mountable to a main body of said image forming apparatus.

5. An apparatus according to claim 1, wherein said information output means also outputs information of an absence of developing agent when the information of the number of printable recording materials becomes zero.

6. An apparatus according to claim 1, further comprising displaying means for displaying the information of the number of printable recording materials outputted by said information output means.

7. An apparatus according to claim 1, wherein the information of the number of printable recording materials outputted by said information output means is displayed by a computer communicated to said image forming apparatus.

8. An apparatus according to claim 1, wherein said memory includes at least one of a RAM, a ROM, a magnetic storage medium, a magnetic bubble memory, and a magneto-optical memory.

9. A method of informing a number of printable sheets in an electrophotographic image forming apparatus, which includes an electrophotographic photosensitive member, developing means for developing a latent image formed on said electrophotographic photosensitive member, and a developer containing portion for containing developer to be used for developing the latent image formed on said electrophotographic photosensitive member by said developing means, said method comprising the steps of:

detecting a residual amount of the developer remaining in said developer containing portion by a detecting means;

storing consumption information with respect to an amount of consumption of the developer in a memory means;

calculating the number of printable sheets on a basis of the consumption information stored in said memory means and consumption rate information of the developer; and informing the number of printable sheets on a basis of a result calculated in calculating the number of printable sheets.

10. A developer container detachably mountable to a main body of an electrophotographic image forming apparatus, said developer container containing a developer to be used for developing a latent image formed on an electrophotographic photosensitive member by a developing means for developing the latent image formed on the electrophotographic photosensitive member, the main body of the electrophotographic image forming apparatus including calculating means, detecting means for sending developer consumption information with respect to an amount of consumption of the developer in said developer container to the calculating means, and displaying means, said developer container comprising:

a developer containing portion for containing the developer; and memory means for storing consumption amount information with respect to the amount of consumption of the developer, the consumption information stored in said memory means being to be sent to the calculating means, wherein, by sending the consumption amount information from said memory means to the calculating means, the calculating means is enabled to calculate a number of printable sheets on the basis of the consumption amount information and the developer consumption information and the displaying means is enabled to inform the number of printable sheets on a basis of a calculated result.

11. An image forming apparatus for forming images on a recording material, comprising:

an electrophotosensitive member;

developing means for developing a latent image formed on said electrophotosensitive member using a developing agent;

a developing agent container for containing the developing agent;

a memory for storing information with respect to an amount of consumption of the developing agent;

computing means for computing a residual amount of the developing agent in said container in accordance with the information with respect to the amount of consumption of the developing agent and consumption rate information of the developing agent; and information output means for outputting information of the residual amount of the developing agent computed by said computing means.

12. An apparatus according to claim 11, wherein the information with respect to the amount of consumption of the developing agent includes at least one of a number of printed recording materials, a driving time of said electrophotosensitive member, an amount of an image information, and a time for which a voltage for developing is applied to said developing means.

13. An apparatus according to claim 11, wherein said developing agent container and said memory are made into a single unit, which is detachably mountable to a main body of said image forming apparatus.

14. An apparatus according to claim 11, wherein said developing agent container, said memory, said electrophotosensitive member, and said developing means are made into a single unit, which is detachably mountable to a main body of said image forming apparatus.

15. An apparatus according to claim 11, further comprising displaying means for displaying the information of the residual amount of the developing agent outputted by said information output means.

16. An apparatus according to claim 11, wherein the information of the residual amount of the developing agent outputted by said information output means is displayed by a computer communicated to said image forming apparatus.

17. An apparatus according to claim 11, wherein said memory includes at least one of a RAM, a ROM, a magnetic storage medium, a magnetic bubble memory, and a magneto-optical memory.

18. An image forming apparatus for forming images on a recording material, comprising:

a unit detachably mountable on a main body of said image forming apparatus, said unit having a memory for storing information with respect to an amount of consumption of said unit;

computing means for computing a usable amount of said unit in accordance with the information with respect to the amount of consumption of said unit and consumption rate information of said unit; and information output means for outputting information of the usable amount of said unit computed by said computing means.

19. An apparatus according to claim 18, wherein the information of the usable amount of said unit is information of a number of printable recording materials.

20. An apparatus according to claim 18, said unit further having a container for containing a developing agent, wherein the information of the usable amount of said unit is an information of a residual amount of the developing agent in said container.

21. An apparatus according to claim 18, wherein the information with respect to the amount of consumption of said unit includes at least one of a number of printed recording materials, a driving time of an electrophotosensitive member, an amount of an image information, and a time for which a voltage for developing is applied to a developing means.

22. An apparatus according to claim 18, further comprising displaying means for displaying the information of the usable amount of said unit outputted by said information output means.

23. An apparatus according to claim 18, wherein the information of the usable amount of said unit outputted by said information output means is displayed by a computer communicated to said image forming apparatus.

24. An apparatus according to claim 18, wherein said memory includes at least one of a RAM, a ROM, a magnetic storage medium, a magnetic bubble memory, and a magneto-optical memory.

25. An image forming apparatus for forming images on a recording material, comprising:

a unit detachably mountable on a main body of said image forming apparatus, said unit including a container for containing a developer and a memory for storing information with respect to an amount of consumption of said unit; and computing means for computing a residual amount of the developer in said container in accordance with the information with respect to the amount of a consumption of said unit and an amount of consumption of a developer per sheet of the recording material;

wherein the amount of consumption of a developer per sheet of the recording material is data computed on the basis of a print history.

26. An image forming apparatus according to claim 25, said computing means further computing a number of printable recording materials in accordance with the residual amount of the developer computed by said computing means and the amount of consumption of the developer per sheet of the recording material.

27. An image forming apparatus according to claim 26, further comprising an information output means for outputting information relating to at least one of the residual amount of the developer and the number of printable recording materials.

28. An image forming apparatus according to claim 27, further comprising a display for displaying the information outputted by said information output means.

29. An image forming apparatus according to claim 27, wherein the information outputted by said information output means is displayed by a computer communicating with said image forming apparatus.

30. An image forming apparatus according to claim 25, wherein the information with respect to the amount of consumption of said unit relates to at least one of a number of printed recording materials, a driving time of an electrophotosensitive member, an amount of an image information, and a time for which a voltage for developing is applied to a developing means.

31. An image forming apparatus according to claim 25, wherein said unit further includes an electrophotosensitive member and developing means for developing a latent image formed on said electrophotosensitive member.

32. An image forming apparatus according to claim 25, wherein said unit further includes a developing means for developing a latent image formed on an electrophotosensitive member.

33. An image forming apparatus for forming images on a recording material, comprising:

a unit detachably mountable on a main body of said image forming apparatus, said unit including a container for containing a developer and a memory for storing information with respect to an amount of consumption of said unit; and computing means for computing a number of printable recording materials in accordance with the information with respect to the amount of a consumption of said unit and an amount of consumption of a developer per sheet of the recording material;

wherein the amount of consumption of a developer per sheet of the recording material is data computed on the basis of a print history.

34. An image forming apparatus according to claim 33, further comprising an information output means for outputting information relating to the number of printable recording materials.

35. An image forming apparatus according to claim 34, further comprising a display for displaying the information outputted by said information output means.

36. An image forming apparatus according to claim 34, wherein the information outputted by said information output means is displayed by a computer communicating with said image forming apparatus.

37. An image forming apparatus according to claim 33, wherein the information with respect to the amount of consumption of said unit relates to at least one of a number of printed recording materials, a driving time of an electrophotosensitive member, an amount of an image information and a time for which a voltage for developing is applied to a developing means.

38. An image forming apparatus according to claim 33, wherein said unit further includes an electrophotosensitive member and developing means for developing a latent image formed on said electrophotosensitive member.

39. An image forming apparatus according to claim 33, wherein said unit further includes a developing means for developing a latent image formed on an electrophotosensitive member.

* * * * *